US005493943A

United States Patent [19]

Horikawa

[11] Patent Number: 5,493,943

[45] Date of Patent: Feb. 27, 1996

[54] PAGE TURNER

[75] Inventor: Masaaki Horikawa, Tenri, Japan

[73] Assignee: Sharp Kabushiki Kaisha, Japan

[21] Appl. No.: 47,491

[22] Filed: Apr. 19, 1993

[30] Foreign Application Priority Data

| | | | |
|---|---|---|---|
| Apr. 23, 1992 | [JP] | Japan | 4-104655 |
| Jun. 12, 1992 | [JP] | Japan | 4-153603 |
| Jul. 30, 1992 | [JP] | Japan | 4-204011 |

[51] Int. Cl.[6] ..... G10G 7/00

[52] U.S. Cl. ..... 84/519; 84/487

[58] Field of Search ..... 84/486, 487, 519; 248/441.1, 446, 451, 458

[56] References Cited

U.S. PATENT DOCUMENTS

| | | | |
|---|---|---|---|
| 377,569 | 2/1888 | Maas | 84/519 |
| 642,565 | 1/1900 | Rogers | 248/446 |
| 664,031 | 12/1900 | Albright | 248/458 |
| 1,220,520 | 3/1917 | Levinson | 84/519 |

FOREIGN PATENT DOCUMENTS

| | | |
|---|---|---|
| 61-239997 | 10/1986 | Japan . |
| 62-181193 | 8/1987 | Japan . |

*Primary Examiner*—Patrick J. Stanzione
*Attorney, Agent, or Firm*—Nixon & Vanderhye

[57] ABSTRACT

A book holder for placing thereon a book held open includes a pair of support plates for respectively supporting the left hand side and the right hand side of the book held open, a pair of support plate adjusting mechanisms for respectively supporting the support plate on the right hand side and the support plate on the left hand side, height position controlling members for controlling respectively the left hand side and the right hand side of the top page of the book held open to be set at predetermined height positions. In the above arrangement, the left hand side and the right hand side of the top page of the book held open can be placed at predetermined height positions by page restraints. Even when scanning the book, for example, by a CCD, a scanning can be carried out without requiring complex device nor mechanism structure.

37 Claims, 20 Drawing Sheets

PAGE TURNER

FIELD OF THE INVENTION

The present invention relates to a page turner which successively turns pages of a book held open on a book holder.

BACKGROUND OF THE INVENTION

Conventionally, many of the devices for reading the content of each page of a book by scanning, such as CCD (Charge Coupled Device) are provided with a page turner such as disclosed in Japanese laid-open patent publication 166296/1980 (Tokukaisho 55-166296).

As shown in FIG. 20, a page turner 130 is provided with a book holder 131 for placing thereon a book B to be held open, and a suction nozzle 133 provided so as to be rotatable by a drive force transmitted from a gear 132. The page turner 130 is arranged as follows: The top page of the book B held open on the book holder 131 is air-sucked by a suction nozzle 133. In this state, by rotating the suction nozzle 133, the pages of the book B are successively turned one by one. In addition, a groove 131*a* provided at the center of the book holder 131 accommodates the spine of the book B in order to set the book B on the book holder 131.

However, in the arrangement of the above conventional page turner 130, since the book B is placed directly on the book holder 131, as the pages of the book B are turned, one side of the opened page gets lower, and the other side of the opened page-gets higher, and thus the position of the top page of the book B held open changes. Moreover, the book holder 131 is a fixed-type, and the book B is set on the book holder 131 only by fitting the spine of the book B into the groove 131*a* formed in the book holder 131. The buckling of the page of book B may occur depending on the quality of the paper used for the pages of book B. Therefore, when scanning the book B by the page turner 130 provided in the CCD, the scanning position must be adjusted according to the height position of the top page of the book B. Furthermore, in order to prevent the occurrence of the buckling of the page, a complex device or mechanism structure is required.

Not only the described suction-type page turner 130, but also that of a sliding-type is available. The sliding-type page turner is arranged as follows: The side of the page is buckled up, for example, by sliding a roller, and a pin is inserted into the buckled portion. Then, the book holder is moved, thereby turning the page.

However, the above sliding-type page turner also presents the following problem: In this type of page turner, the pages of the book are turned by moving the book holder only in one direction. Therefore, when turning a plurality of pages in one direction, every time a page is turned, the book holder must be moved back to the original position. This means that only a page is turned by a two-way movement of the book holder, thereby presenting the problem of low operating speed. Moreover, when turning the pages of the book using the described sliding-type page turner, page turning means are required separately for turning the pages on the left hand side of the book, and for turning the pages on the right hand side of the book. Because this makes the control system complicated, the compact-size page turner cannot be achieved.

SUMMARY OF THE INVENTION

This invention provides a book page turner which enables a constant top page height position to be maintained irrespective of the number of turned pages.

In order to achieve this, the exemplary page turner embodiment includes at least the following:

(a) a book holder with a pair of support plates which support a left hand side and a right hand side of a book;

(b) a pair of support plate movers activating the support plate on the left hand side and the support plate on the right hand side to move up and down;

(c) height position control members in predetermined height positions above the left hand side and the right hand side of the book; and (d) a page turner for successively turning pages of the book.

According to the above arrangement, the support plate on the left hand side, and the support plate on the right hand side can be moved by its respective support plate mover, and the left hand side and the right hand side of the book are respectively sandwiched between the support plates and the height position controlling members. As a result, a, constant height position of the top pages can be always maintained irrespective of the number of book pages.

Buckling of book pages can thus be prevented irrespective of the quality of the paper used for the pages of the book. This enables scanning the book by a CCD sensor, for example, without requiring a complex device or mechanism structure.

This invention also provides a compact-size page turner which permits prompt turning of pages with a simple control system. In order to achieve such prompt turning, the exemplary embodiment of the page turner includes the following:

(e) a book holder having a support plate for supporting a book which is held open;

(f) a support plate rotator for rotating the support plate;

(g) a book holder mover for moving the book holder along a lengthwise direction; and (h) a page raiser for raising a top page of the book held open on the book holder, and also for enabling the top page to be released.

According to this arrangement, by rotating the support plate by 180° at the turning point, two pages of the book can be turned in a two-way movement of the book holder. This permits a prompt operating speed in turning pages. Moreover, since the book holder mover and the page raiser need to correspond to only one moving direction of the book holder, the size of the page turner can be made smaller.

This invention also provides a page turner which enables a book to be held open in a predetermined position in a stable page turning operation. For example, the page turner may include the following:

(I) a book holder for holding a held-open book;

(j) a position controlling member, provided along a circumference of the book holder, for controlling the position of the book to be set on the book holder;

(k) height position controlling members, provided in a predetermined height position above the left hand side and the right hand side of the book held open on the book holder; and (l) a page turner for successively turning pages of the book placed on the book holder.

According to this arrangement, the set position of the book to be held open on the book holder is controlled by the set position controlling member, and its height position is controlled by the height position controlling member. Because this permits the book to be held open in a predetermined position, a stable page turning operation can be achieved.

BRIEF DESCRIPTION OF THE DRAWINGS

For a fuller understanding of the nature and advantages of the invention, reference should be made to the ensuing detailed description taken in conjunction with the accompanying drawings.

FIG. 2(*b*) is a front view showing the state of a height position of a top page of an opened book being controlled in the case where the number of pages on the left hand side of the opened book is the same as that on the right hand side.

FIG. 2(*c*) is a front view showing the state of a height position of a top page of an opened book being controlled in the case where the number of pages on the left hand side of the opened page is smaller than that of the right hand side.

FIG. 5(*b*) is a side view showing the initial position of the book placed on the book holder.

FIG. 6(*b*) is a front view showing the state where the support plate on the right hand side is moved down while the top page of the book of FIG. 6(*a*) is being sucked.

FIG. 7(*b*) is a front view showing the state where a book holder is moved while the suction nozzle in FIG. 7(*a*) is moved up.

FIG. 7(*c*) is a front view showing the state where the book holder is further moved, and the top page of the opened book ceases from being sucked by the suction nozzle.

FIG. 8(*b*) is a front view showing the state where the top page of the opened book released onto the left hand side of the opened book is in contact with a height position controlling member by moving up the support plate on the left hand side.

FIG. 11(*b*) is a front view showing a page suction mechanism of the page turner of FIG. 9.

FIG. 11(*c*) is a front view showing a page suction mechanism of the page turner of FIG. 9.

FIG. 11(*d*) is a front view showing a page suction mechanism of the page turner of FIG. 9.

FIG. 12(*b*) is a front view showing a process for moving the book holder by the book holder transporting mechanism of the page turner of FIG. 9.

FIG. 12(*c*) is a front view showing a process for moving the book holder by the book holder transporting mechanism of the page turner of FIG. 9.

FIG. 12(*d*) is a front view showing the state where the book holder is rotated by a book holder rotating mechanism of the page turner.

FIG. 13(*b*) is a front view showing a process for sucking the top page of the book by the page suction mechanism, the book being placed on the book holder which is rotated by 180° by the book holder rotating mechanism.

FIG. 13(*c*) is a front view showing a process for sucking the top page of the book by the page suction mechanism, the book being placed on the book holder which is rotated by 180°.

FIG. 13 (*d*) is a front view showing a process for sucking the top page of the book by the page suction mechanism, the book being placed on the book holder which is rotated by 180°.

FIG. 14(*b*) is a front view showing a process for turning a page by moving the book holder back to the original position by the book holder transporting mechanism.

FIG. 14(*c*) is a front view showing a process for turning a page by moving the book holder back to the original position by the book holder transporting mechanism.

FIG. 18(*b*) is a front view showing a process for sucking a page by the page suction mechanism of the page turner of FIG. 15.

FIG. 18(*c*) is a front view showing a process for sucking a page by the page suction mechanism of the page turner of FIG. 15.

FIG. 18(*d*) is a front view showing the book holder being moved by the book holder transporting mechanism of the page turner of FIG. 15.

FIG. 19(*b*) is a front view showing a process for pushing the page by the page dropping mechanism of the page turner of FIG. 15.

FIG. 19(*c*) is a front view showing a process for pushing the page by the page dropping mechanism of the page turner of FIG. 15.

DESCRIPTION OF THE EMBODIMENTS

[EMBODIMENT 1]

The following description will discuss one embodiment of the present invention with reference to FIG. 1 through FIGS. 8(*a*)(*b*).

Figure 1:
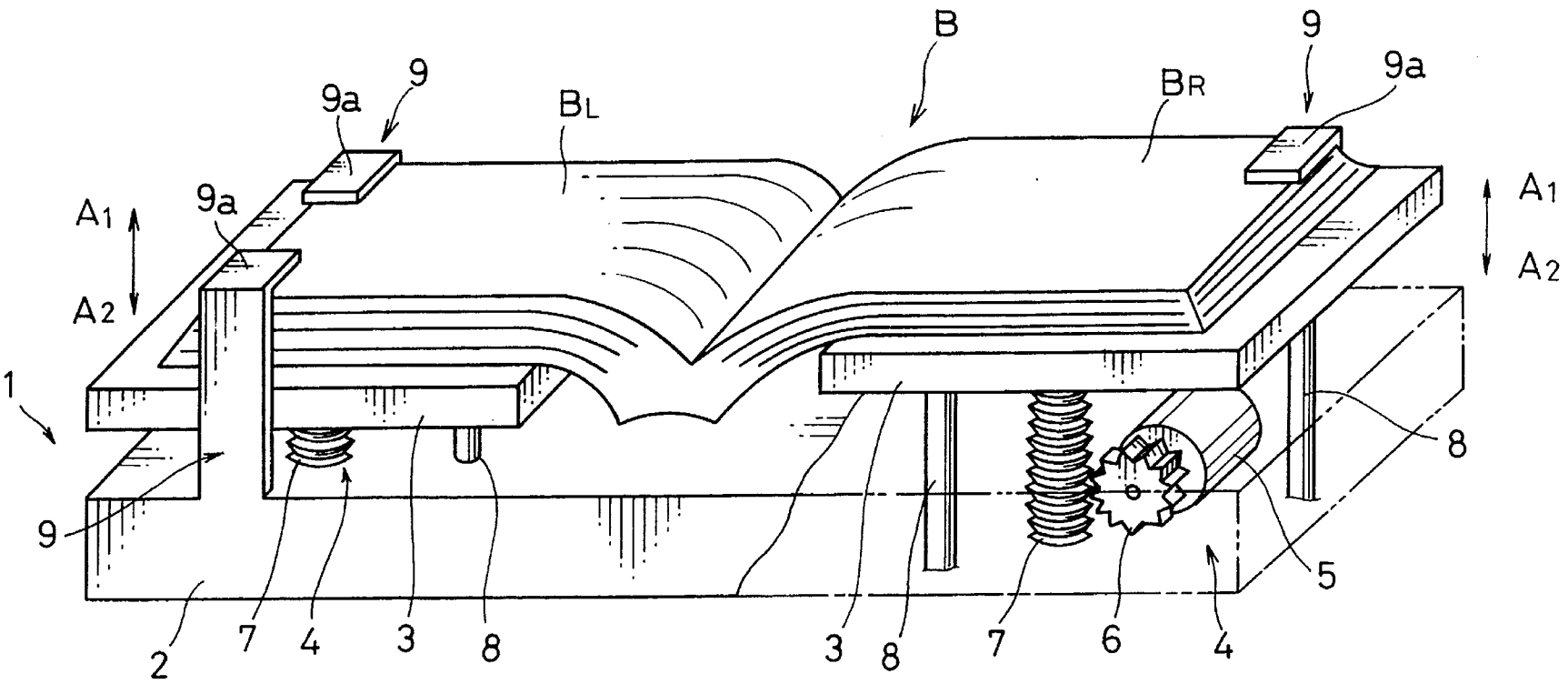
FIG. 1 is a perspective view showing the configuration of a page turner of the first embodiment in accordance with the present invention.

As shown in FIG. 1, a page turner of the present embodiment is provided with a book holder 1 for placing thereon the book B to be held open. The book holder 1 includes a rectangular base 2. Further, a pair of support plates 3 for respectively supporting the left hand side $B_L$ and the right hand side $B_R$ of the book B to be held open, and a pair of support plate adjusting mechanisms 4 (support plate moving means) for respectively moving the pair of support plates 3 up and down in the direction of $A_1$–$A_2$.

The support plate adjusting mechanism 4 is provided with a motor 5, a gear 6, and a rack member 7. The motor 5 is capable of rotating in both forward and reverse directions, and serves as a drive source for moving the support plate 3 up and down. The gear 6 is coupled to a drive shaft of the motor 5. The rack member 7 is provided on the center of the back surface of the support plate 3 perpendicular to the support plate 3. Then, the support plate adjusting mechanism 4 rotates the gear 6 by the motor 5. The rotations of the gear 6 are transmitted to the rack member 7 so as to move it up and down, thereby adjusting the position of the support plate 3 in the direction of $A_1$–$A_2$.

A plurality of guide shafts 8 are coupled to the back surface of the support plate 3 perpendicularly. Because the guide shafts 8 are provided so as to enter guide holes formed on the base 2, the smooth up and down movement of the support plate 3 can be ensured. The base 2 is provided with four height position adjusting members 9 at the corners of the book B (one of them is not shown in FIG. 1), for controlling the height position of the book B. The position adjusting member 9 is composed of a plate extending perpendicularly from the base 2, and a page restraint 9*a* extending from the top end of the plate provided so that the top end thereof is bent inward.

Figure 2A:
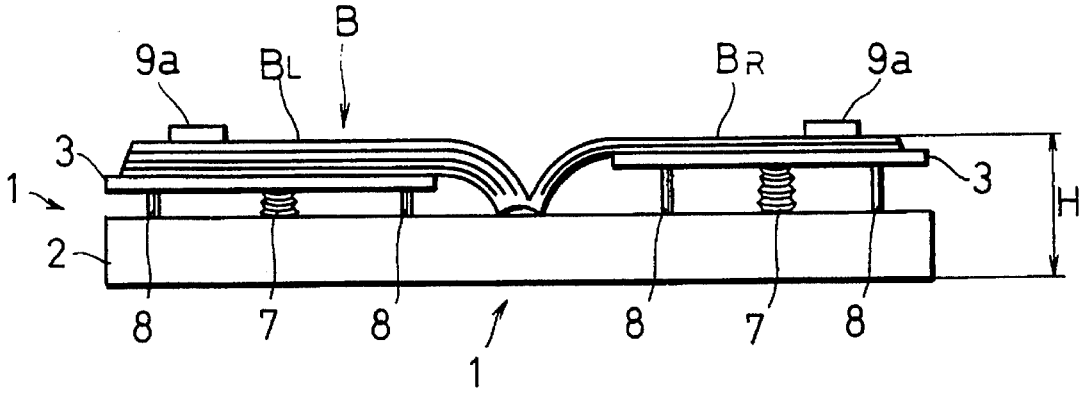
FIG. 2(*a*) is a front view showing the state of a height position of a top page of an opened book being controlled in the case where the number of pages on the left hand side of the opened book is larger than that on the right hand side.
Figure 2B:
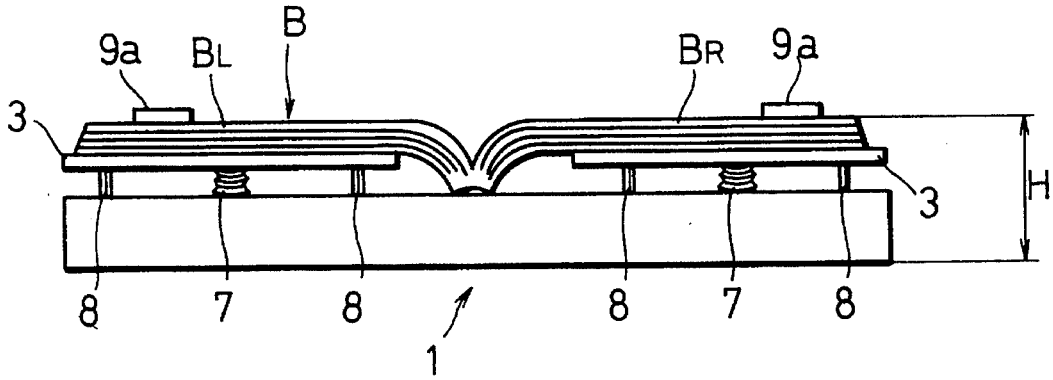
Figure 2C:
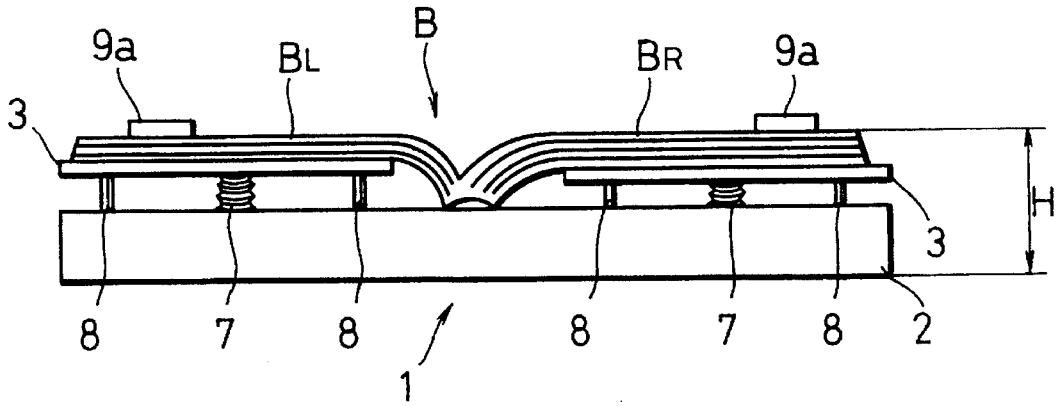

FIG. 2(*a*) shows the case where the number of pages on the left hand side $B_L$ of the opened book B is larger than that on the right hand side $B_R$. FIG. 2(*b*) shows the case where the number of pages on the left hand side $B_L$ of the opened book B is the same as that on the right hand side $B_R$. FIG. 2(*c*) shows the case where the number of pages on the left hand side $B_L$ of the opened page is smaller than that of the right hand side $B_R$. In any of the above three cases, the position of the book B held open on the book holder 1 is set such that the bottom surface of the base 2 and the top page of the book B maintains a predetermined height H. This is achieved by pressing the left hand side $B_L$ and the right hand side $B_R$ of the book B respectively between the support plates 3 and the page restraints 9*a*.

Figure 3:
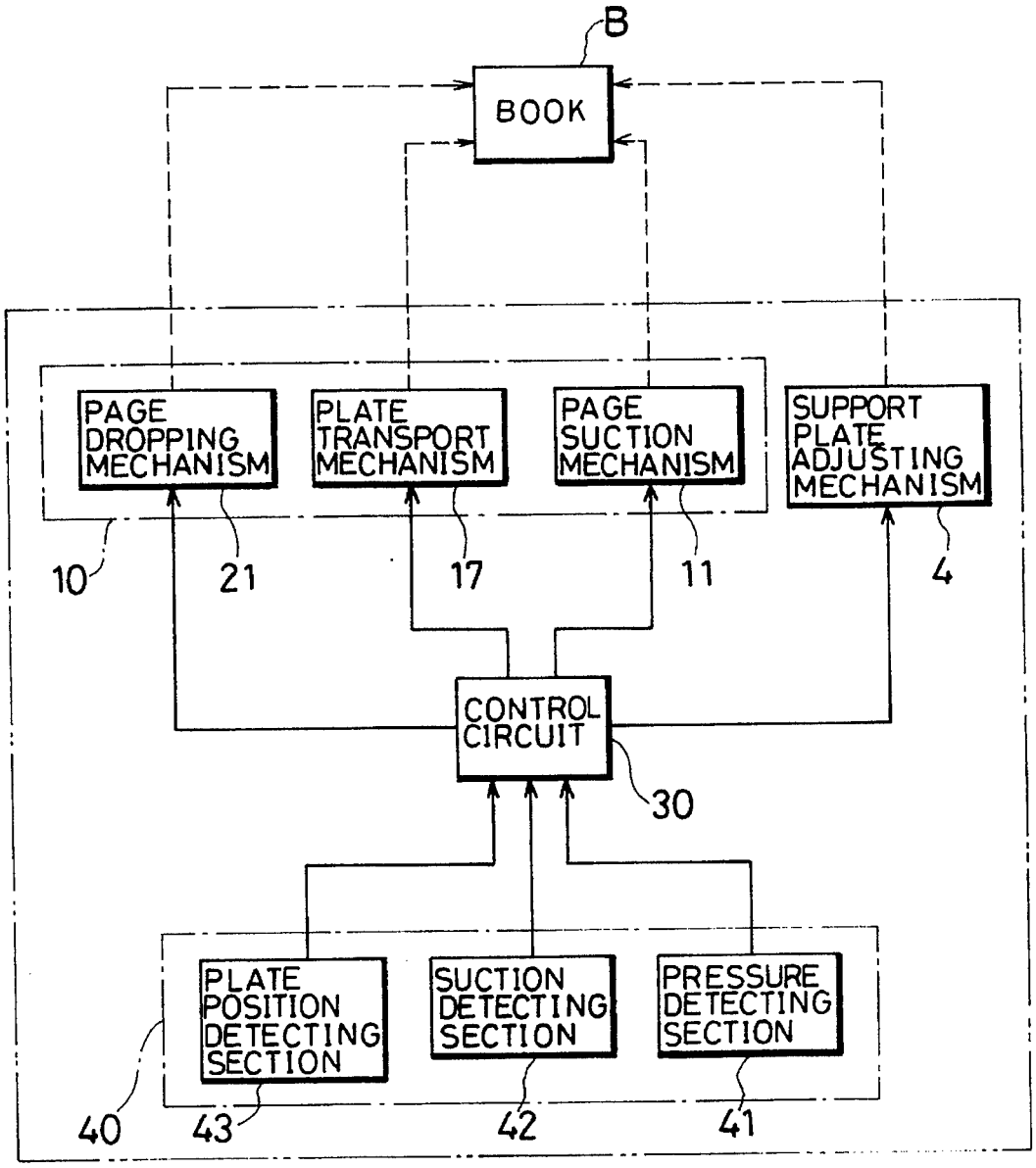
FIG. 3 is a block diagram showing various components of the page turner of FIG. 1.

As shown in FIG. 3, the page turner of the present embodiment is provided with page turning means 10, a control circuit 30, and detection means 40. The control circuit 30 controls respective operations of the page turning means 10 and the support plate adjusting mechanism 4. In order to enable the above control by the control circuit 30, the detection means 40 sends the result of detection (to be described later) to the control circuit 30.

The page turner 10 includes a page suction mechanism 11, a book holder transport mechanism 17, and a page dropping mechanism 21. The page suction mechanism 11 is provided for sucking the top page of the opened book B. The book holder transport mechanism 17 is provided for transporting the book holder 1 in the direction perpendicular to the moving direction of the support plate 3, and parallel to the lengthwise direction ($C_1$–$C_2$) of the book holder 1 (to be described later). The page dropping mechanism 21 is provided for dropping the pages being turned from one side to the other side of the book B held open.

Figure 4:
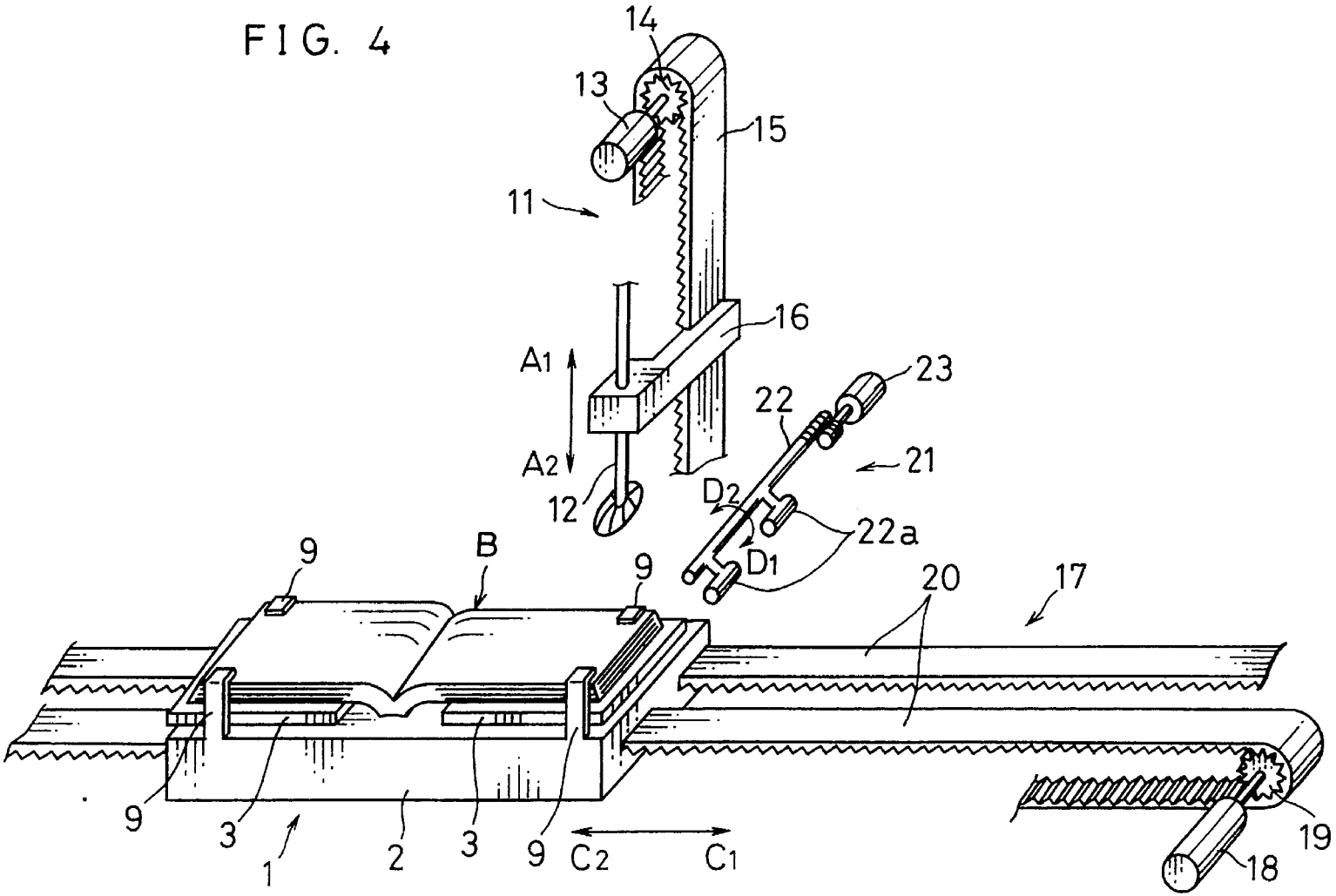
FIG. 4 is a perspective view showing the page turner.

As shown in FIG. 4, the page suction mechanism 11 is composed of a suction nozzle 12, a motor 13, a gear 14, a toothed belt 15, and a connecting member 1.6. The central axis of the suction nozzle 12 is set parallel to the moving direction ($A_1$–$A_2$) of the support plate 3, so as to enable the up-down motion ($A_1$–$A_2$). The motor 13 serves as a drive force for moving the suction nozzle 12 in the up-down direction. Additionally, a vacuum pump (not shown) is connected to the suction nozzle 12 so as to absorb air through a suction opening.

The book holder transport mechanism 17 is composed of a motor 18, a gear 19, and a toothed belt 20. The motor 18 serves as a drive source for moving the book holder 1 in the $C_{\cdot-C2}$ direction. The gear 19 transmits the drive force from the motor 18 to the toothed belt 20 as the movement of the book holder 1.

The page dropping mechanism 21 is composed of a shaft member 22, and a motor 23. The axis of the shaft member 22 is provided in the direction perpendicular to the moving direction of the support plate 3 ($A_1$–$A_2$) and the moving direction of the book holder 1 ($C_1$–$C_2$). The motor 23 serves as a drive force for rotating the shaft member 22 in the direction of $D_1$–$D_2$. The shaft member 22 is provided with a pair of parts 22*a* for dropping pages along a shaft portion.

The detection means 40 is composed of a pressure detecting section 41, a suction detecting section 42, and a plate position detecting section 43. The pressure detecting section 41 detects the pressure exerted on the top page of the opened book B by a sensor (not shown) provided on the page restraint 9*a* of the height position controlling member 9.

The suction detecting section 42 detects the position of the suction nozzle 12 in the direction of $A_1$–$A_2$ by an optical sensor (not shown). The suction detecting section 42 also detects the suction condition of the suction nozzle 12 by a vacuum sensor (not shown). The plate position detecting section 43 detects the position of the book holder 1 in the $C_1$–$C_2$ direction by the optical sensor (not shown). Additionally, the above detecting sections 41–43 are arranged so as to carry out respective detecting operations of the sensors. However, it should be noted here that the present invention is not limited to this arrangement.

Figure 5:
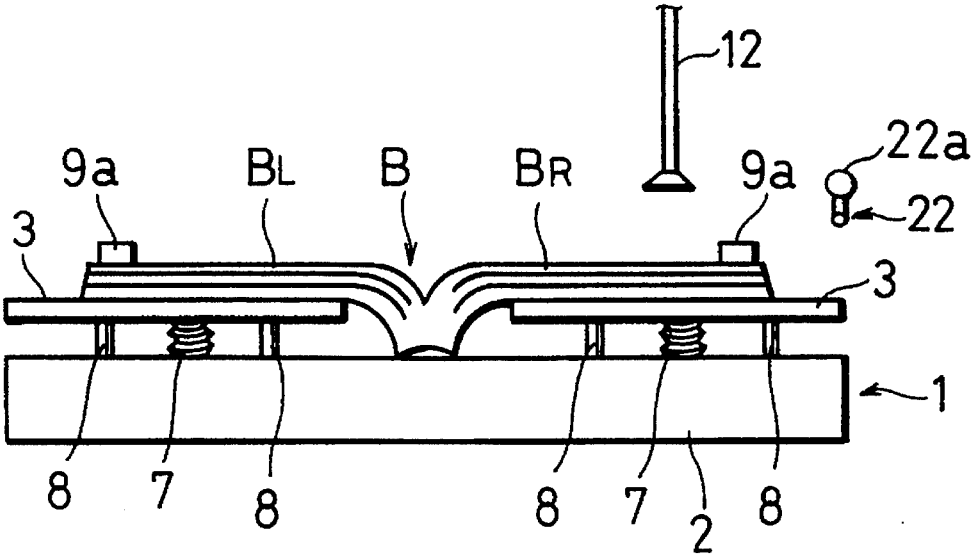
FIG. 5(*a*) is a front view showing an initial position of the book placed on the book holder.
Figure 5:
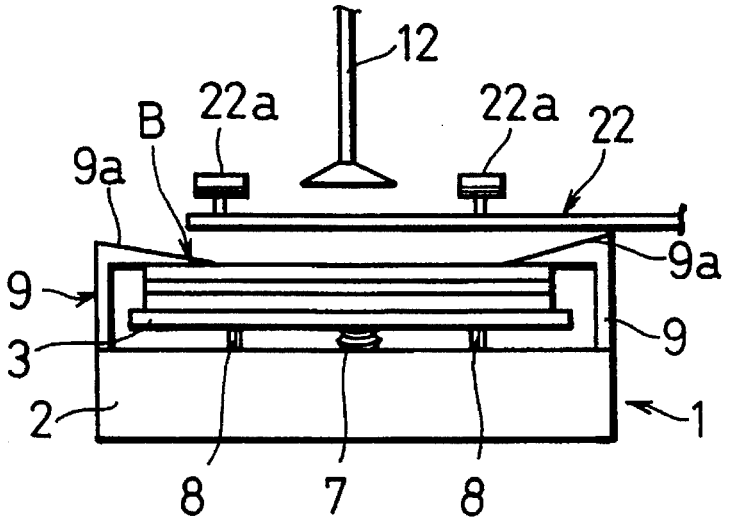
Figure 6:
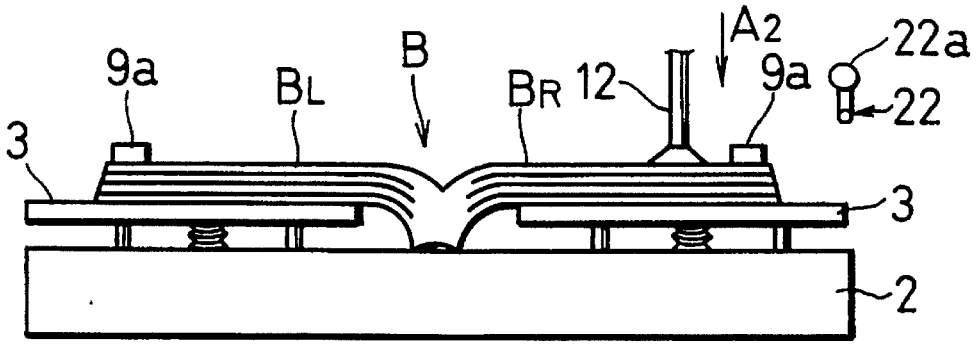
FIG. 6(*a*) is a front view showing the state where a top page on the right hand side of the opened book is sucked by a suction nozzle.
Figure 6:
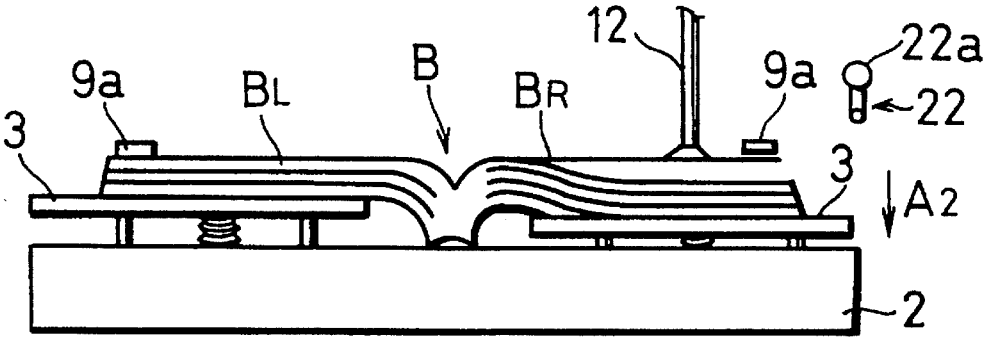
Figure 7A:
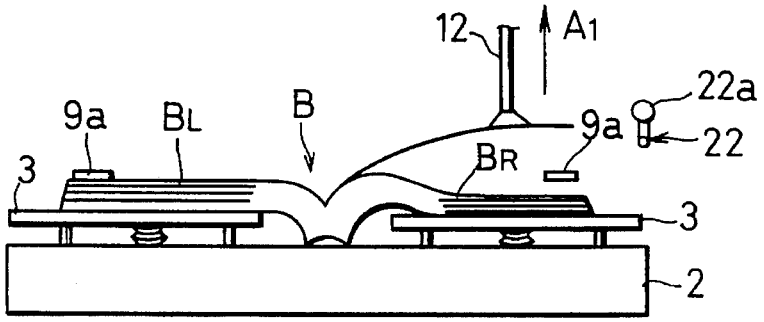
FIG. 7(*a*) is a front view showing the state where the suction nozzle is moved up while the top page of the opened book is being sucked.
Figure 7B:
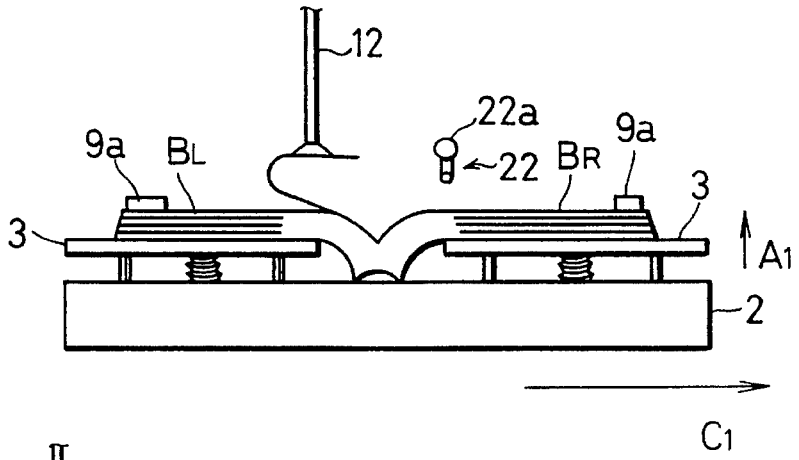
Figure 7C:
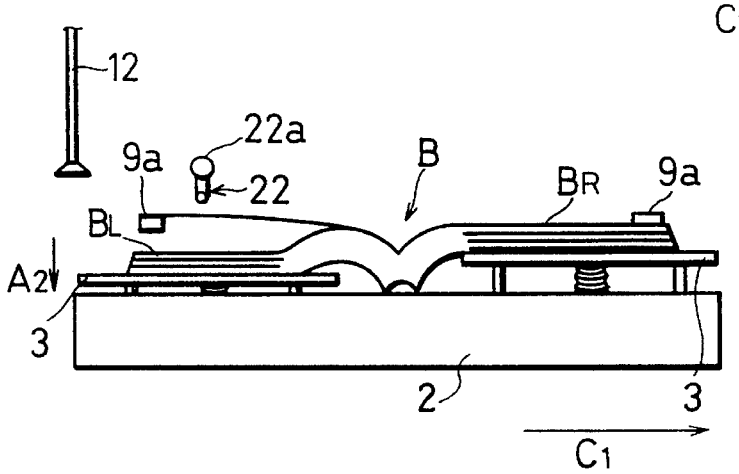
Figure 8A:
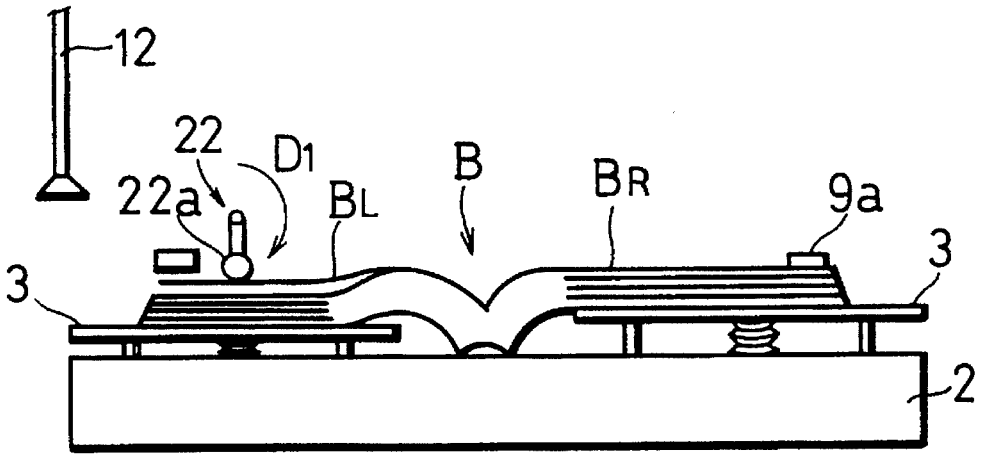
FIG. 8(*a*) is a front view showing the state where the top page of the opened book is released onto the left hand side of the opened book by rotating a shaft member.
Figure 8B:
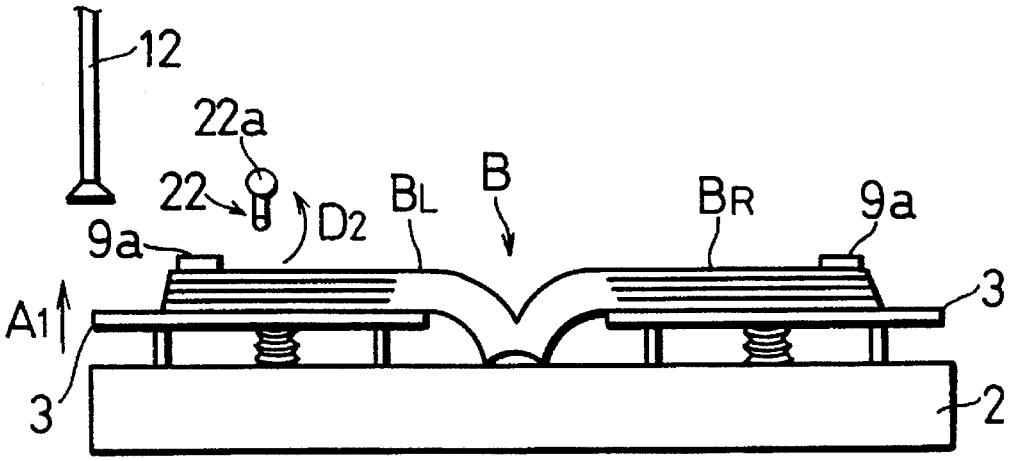

In the above arrangement of the page turner of the present embodiment, the following will discuss a sequential page turning operation with reference to FIGS. 5(*a*)(*b*), FIGS. 6(*a*)(*b*), FIGS. 7(*a*)(*b*)(*c*), and FIGS. 8(*a*)(*b*). In the explanation, the pages of the opened book B are turned from the right hand side $B_R$ to the left hand side $B_L$.

As shown in FIG. 5(*a*)(*b*), the book B is held open on the book holder 1, and both left and right hand sides $B_L$ and $B_R$ are respectively pressed between the support plates 3 and the page restraints 9a of the position controlling member 9. In this state, the suction nozzle 12 is placed above the right hand side $B_R$ of the opened book B. Further, the shaft member 22 is placed on the right hand side of the suction nozzle 12.

Based on the result of detection in the suction detecting section 42, the page suction mechanism 11 is controlled by the control circuit 30. Then, the suction nozzle 12 moves down in the direction of $A_2$ so as to suck the top page of the opened book B as shown in FIG. 6(*a*). In this state, the support plate 3 moves in the direction of $A_2$ as shown in FIG. 6(*b*).

As shown in FIG. 7(*a*), the suction nozzle 12 moves back in the direction of $A_1$ with the top page being sucked. In this state, the right hand side of the support plate 3 moves in the direction of $A_1$, and the base 2 moves in the direction of $C_1$ as shown in FIG. 7(*b*). Here, the respective movements of the right hand side of the support plate 3 and the base 2 are controlled by the support plate adjusting mechanism 4 and the plate transport mechanism 17 which are controlled by the control circuit 30 based on the respective results of detection in the pressure detecting section 41 and the plate position detecting section 43.

As shown in FIG. 7(*c*), with the further movement of the base 2 in the direction of $C_1$, the suction of the top page by the suction nozzle 12 ceases. Thereafter, the support plate 3 on the left hand side is moved in the direction of $A_2$. Here, the top page being ceased from being sucked is released onto the page restraint 9a placed above the left hand side $B_L$ of the opened book B. Further, the shaft member 22 is placed above the top page.

Next, the page dropping mechanism 21 is activated by the control circuit 30 so as to rotate the shaft member 22 in the direction of $D_1$ as shown in FIG. 8(*a*). As a result, the released top page is pressed by the pair of parts 22a for dropping pages of the shaft member 22 so as to be inserted between the page restraint 9a and the left hand side $B_L$ of the opened book B. Furthermore, the shaft member 22 is rotated in the direction of $D_2$, and the support plate 3 on the left hand side is moved in the direction of $A_1$, thereby terminating the sequential page turning operation. Thereafter, by repeating the above process, the pages of the book B are successively turned one by one.

As described, the page turner of the present embodiment is provided with a pair of support plates 3, a pair of support plate adjusting mechanisms 4, and the position controlling member 9. The support plates 3 are provided on the left hand side $B_L$ and the right hand side $B_R$ of the opened book B so as to respectively support both sides of the book B. The support plate adjusting mechanisms 4, provided on both right hand side and the left hand side, move respectively the support plate 3 on the right hand side and the support plate 3 on the left hand side up and down. The height position controlling member 9 controls the height position of the top page to be a predetermined height position H.

In this arrangement, both left hand side $B_L$ and the right hand side $B_R$ of the opened book B are supported by the support plate 3 and the page restraints 9a of the height position controlling member 9. This permits top pages of both the left hand side $B_L$ and the right hand side $B_R$ of the opened book B to be set at respective predetermined height position by the page restraints 9a. Therefore, when scanning the book by CCD, etc., neither a complicated device nor mechanism structure is required, thereby enabling a simple scanning operation.

[EMBODIMENT 2]

The following description will discuss another embodiment of the present invention with reference to FIG. 9–FIGS. 14(*a*)(*b*)(*c*).

Figure 9:
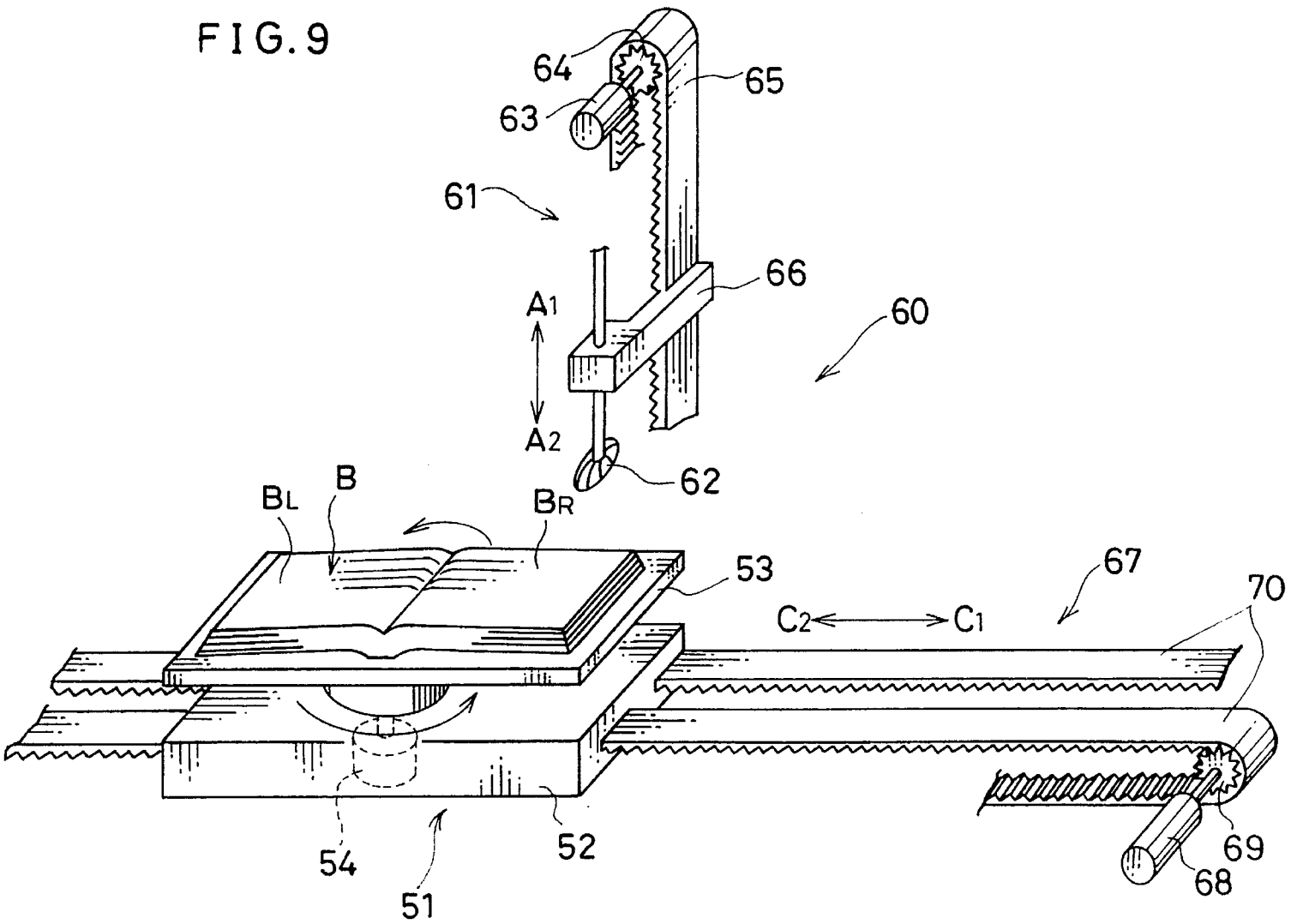
FIG. 9 is a perspective view showing a page turner of another embodiment in accordance with the present embodiment.

As shown in FIG. 9, a page turner of the present embodiment is provided with a book holder 51 for placing thereon the book B to be held open, and page turning means 60 for successively turning the pages of the book B held open on the book holder 51. The book holder 51 includes a rectangular base 52, and a support plate 53, placed above the base 52 for supporting the opened book B. Further, a motor 54 which is a part of a support plate rotating mechanism (support plate rotation means) is fitted into the base 52. A drive shaft of the motor 54 is fixed to the support plate 53 so that the support plate 53 can rotate with respect to the base 52.

The page turning means 60 is composed of a page suction mechanism 61 (page raising means) for sucking the top page of the opened book B, and a book holder transport mechanism 67 (book holder moving means). The book holder transport mechanism 67 is provided for transporting the book holder 51 in the direction perpendicular to an axis direction ($A_1$–$A_2$) of the motor 54 and parallel to the lengthwise direction ($C_1$–$C_2$) of the book holder 51.

The page suction mechanism 61 is provided in such a way that an axis of the suction nozzle 62 is parallel to the axis of the motor 54. The page suction mechanism 61 includes a suction nozzle 62 capable of moving in the direction of $A_2$–$A_1$, a motor 63 which serves as a drive source for moving the suction nozzle 62. The page suction mechanism 61 also includes a gear 64, a toothed belt 65, and a connecting member 66 which transmit the drive force from the motor 63 to the suction nozzle 62. In addition, a vacuum pump 71 is connected to the suction nozzle 62 so as to absorb air through a suction opening as shown in FIG. 10.

The book holder transport mechanism 67 includes a motor 68 which serves as a drive force for moving the book holder 51 in the direction of $C_1$–$C_2$, and a gear 69 and a pair of toothed belts 70 set parallel for transmitting the drive force from the motor 68 as a movement of the book holder 51.

Figure 10:
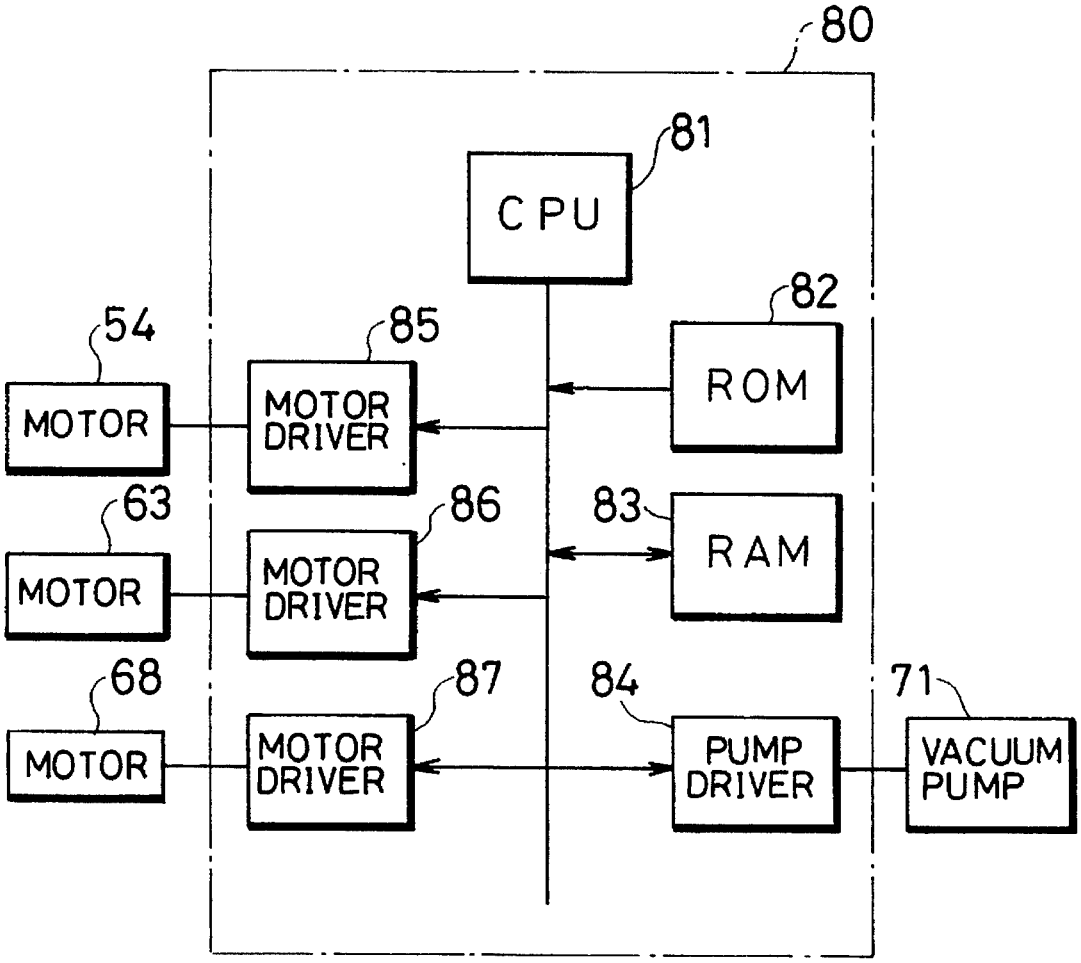
FIG. 10 is a block diagram showing a control section which is a part of the page turner of FIG. 9.
Figure 11A:
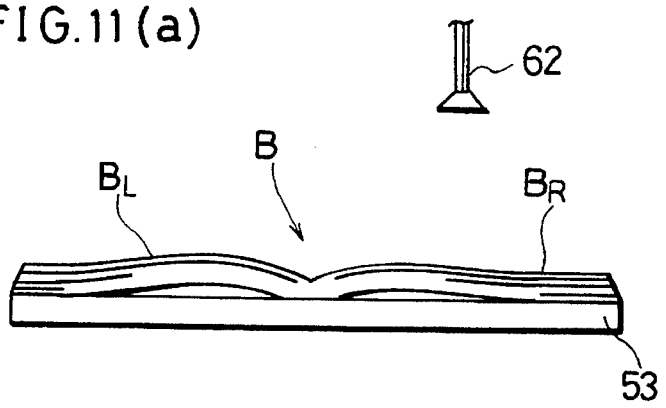
FIG. 11(*a*) is a front view showing a page suction mechanism of the page turner of FIG. 9.
Figure 11B:
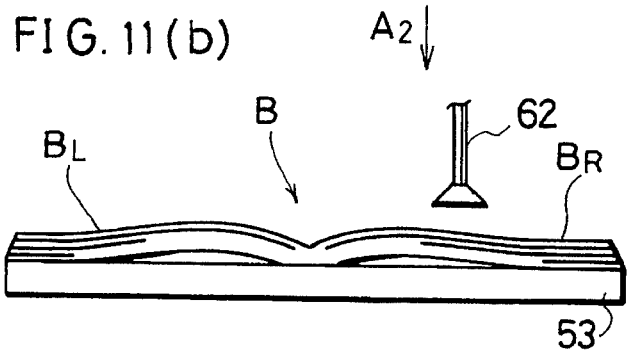
Figure 11C:
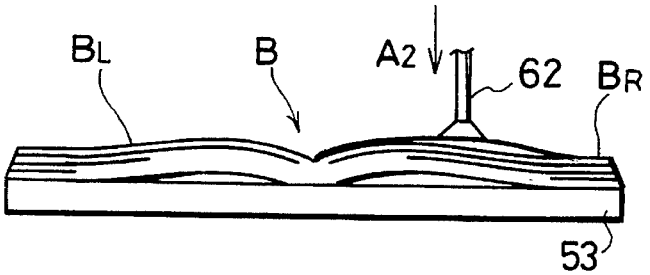
Figure 11D:
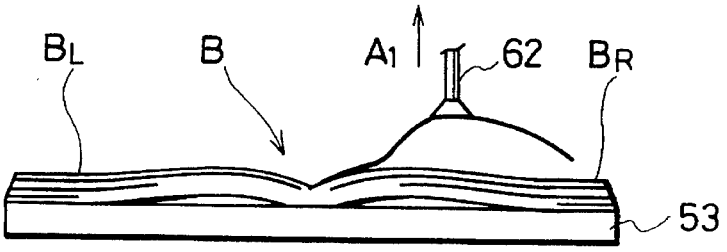

As shown in FIG. 10, the page turner of the present embodiment is also provided with a control unit 80 (control means) for controlling the respective operations of the support plate rotating mechanism and the page turning means 60. The control unit 80 includes a CPU 81 (Central Processing Unit) for executing the program by controlling the respective operations of the components. Further, a ROM 82 (Read Only Memory) for storing control programs, and a RAM 83 (Random Access Memory) for storing various kinds of data are connected to the CPU 81.

A pump driver 84 and motor drivers 85–87 are connected to the CPU 81 via an interface (not shown). The vacuum pump 71 is connected to the pump driver 84, and the motors 54, 63, and 68 are respectively connected to the motor drivers 85–87.

The control unit 80 controls the pump driver 84, and motor drivers 85–87 based on the control of CPU 81 using drive data. As a result, the pump driver 84 controls the air-suction of the vacuum pump 71, thereby controlling the sucking operation of the suction nozzle 62. The motor driver 85 controls the drive of the motor 54 so as to control the rotations of the support plate 53. The motor driver 86 controls the drive of the motor 63 so as to control the movement of the suction nozzle 62. The motor driver 87 controls the drive of the motor 68 so as to control the movement of the book holder 51.

Figure 12:
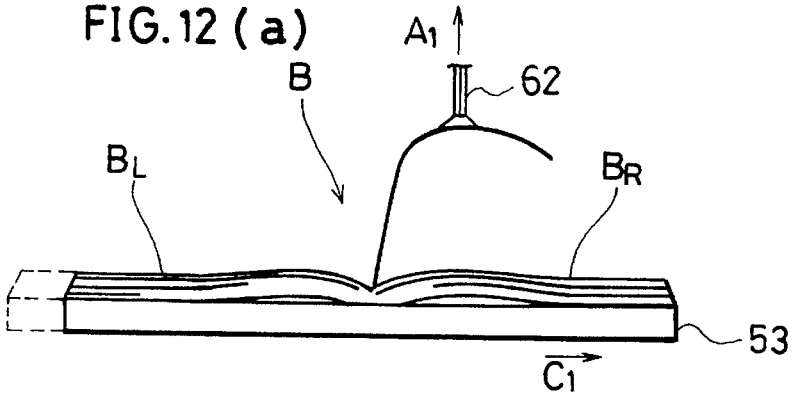
FIG. 12(*a*) is a front view showing a process for moving the book holder by a book holder transporting mechanism of the page turner of FIG. 9.
Figure 12:
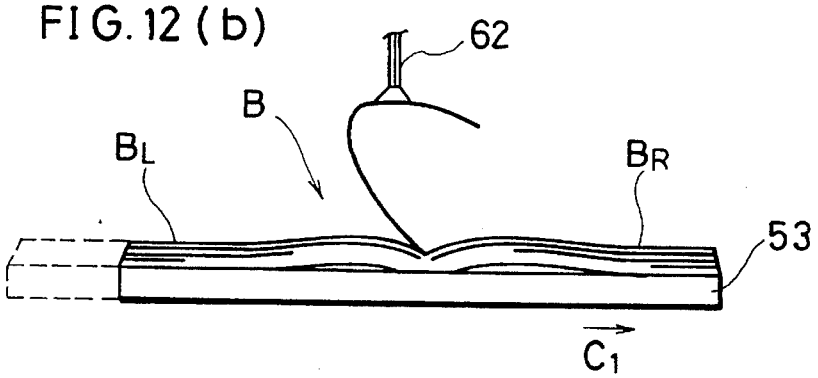
Figure 12:
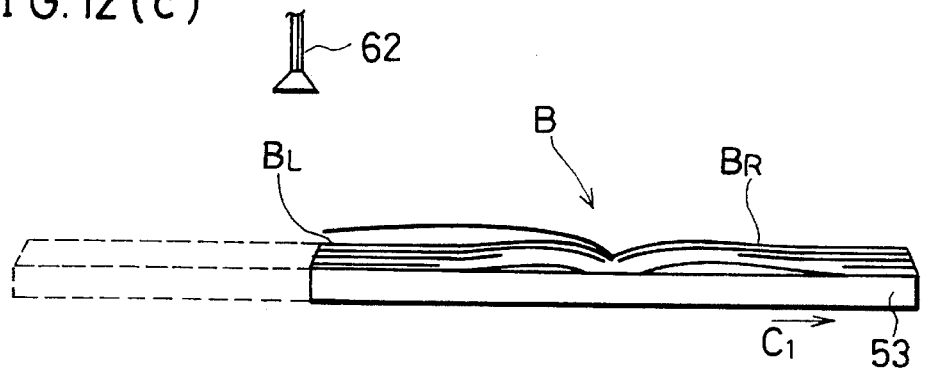
Figure 12:
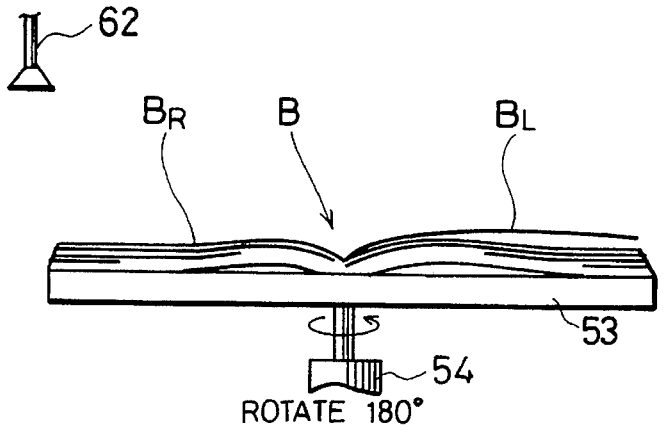
Figure 13:
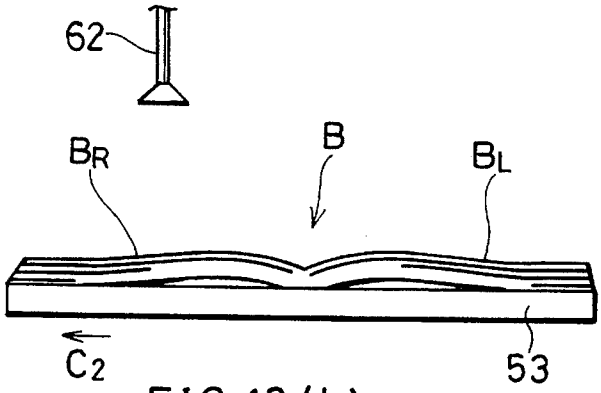
FIG. 13(*a*) is a front view showing a process for sucking a top page of the book by the page suction mechanism, the book being placed on the book holder which is rotated by 180° by the book holder rotating mechanism.
Figure 13:
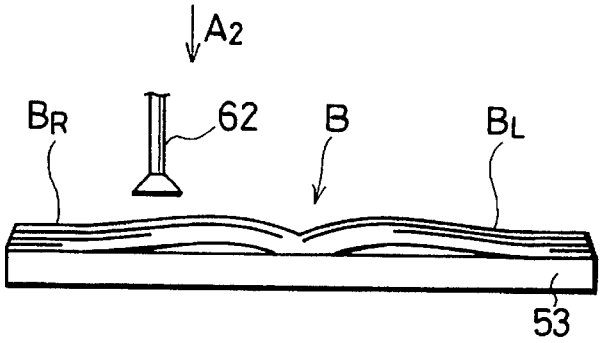
Figure 13:
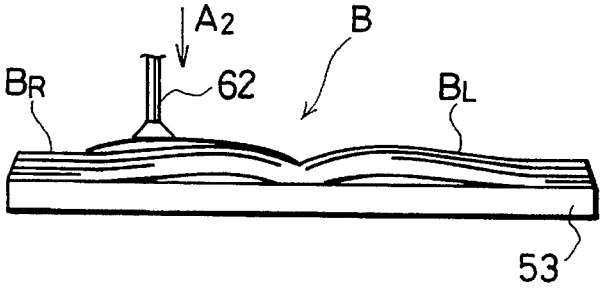
Figure 13:
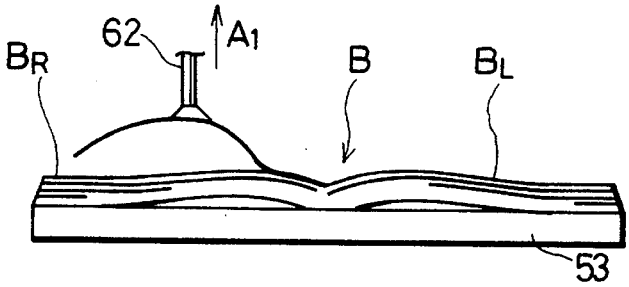
Figure 14:
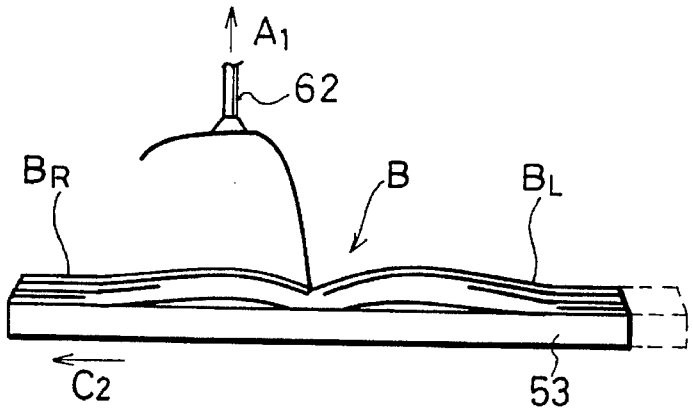
FIG. 14(*a*) is a front view showing a process for turning a page by moving the book holder back to the original position by the book holder transporting mechanism.
Figure 14:
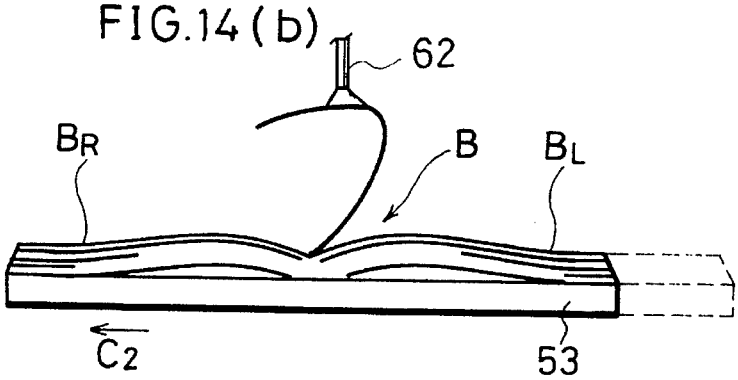
Figure 14:
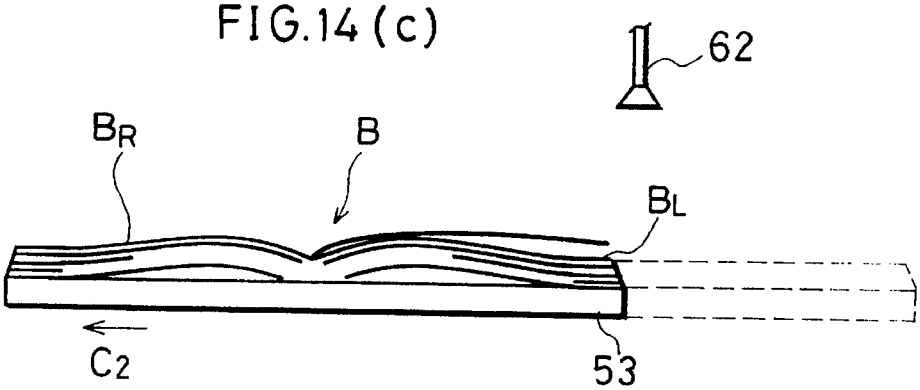

In the above arrangement of the page turner of the present embodiment, the following will discuss a sequential page turning operation with reference to FIGS. 11(*a*)(*b*)(*c*)(*d*), FIGS. 12(*a*)(*b*)(*c*)(*d*), FIGS. 13(*a*)(*b*)(*c*)(*d*), and FIGS. 14(*a*)(*b*)(*c*). In the explanation, the pages of the opened book B are turned from the right hand side $B_R$ to the left hand side $B_L$.

First, the suction nozzle 62 is placed above the right hand side $B_R$ of the opened book B as shown in FIG. 11(*a*). Then, the suction nozzle 62 moves down in the direction of $A_2$ so as to suck the top page of the opened book B as shown in FIG. 11(*b*)(*c*). Thus, the right hand side $B_R$ of the top page of the opened book B is sucked by the suction nozzle 62. Thereafter, the suction nozzle 62 moves back in the direction of $A_1$ while sucking the right hand side $B_R$ of the top page of the opened book B as shown in FIG. 11(*d*).

With the backward movement of the suction nozzle 62, the support plate 53 (the book holder 51) is moved in the direction of $C_1$ as shown in FIG. 12(*a*). When the support plate 53 is further moved in the direction of $C_1$ as shown in FIG. 12(*b*), the top page of the opened book B ceases from being sucked by the suction nozzle 62, and is released onto the left hand side $B_L$ of the opened book B. After the page of the book B is turned from the right hand side $B_R$ to the left hand side $B_L$, the motor 54 is activated so as to rotate the support plate 53 by 180° as shown in FIG. 12(*d*).

Next, as shown in FIG. 13(*a*), when the support plate 53 is slightly moved in the direction of $C_2$, the suction nozzle 62 is placed above the right hand side $B_R$ of the top page of the opened book B. Then, the suction nozzle 62 is moved down in the direction of $A_2$ in the air-suction state as shown in FIGS. 13(*b*)(*c*). Thus, the right hand side $B_R$ of the top page of the opened book B is sucked by the suction nozzle 62. As shown in FIG. 13(*d*), the suction nozzle 62 is moved back in the direction of $A_1$ while sucking the right hand side $B_R$ of the top page of the opened book B.

With the backward movement of the suction nozzle 62, the support plate 53 (the book holder 51) is moved in the direction of $C_2$ as shown in FIG. 14(*a*). When the support plate 53 is further moved in the direction of $C_2$ as shown in FIG. 14(*b*), the top page of the opened book B ceases from being sucked by the suction nozzle 62, and released onto the right hand side $B_R$ of the opened book B as shown in FIG. 14(*c*). Thereafter, the motor 54 is activated so as to rotate the support plate 53 by 180°, in the meantime, it is activated so as to slightly move the support plate 53 in the direction of $C_1$ to the original position shown in FIG. 11(*a*). Then, by repeating the above sequential process, the pages of the opened book B are successively turned one by one.

As described, the page turner of the present embodiment includes the book holder 51 including the support plate 53, for placing thereon the book B to be held open, the motor 54 for rotating the support plate 53, the page suction mechanism 61 for sucking the top page of the book B held open on the book holder 51, and the book holder transport mechanism 67 for moving the book holder 51 along the lengthwise direction thereof.

In the above arrangement, regarding the two-way movement of the book holder 51 by the book holder transport mechanism 67, by rotating the support plate 53 by 180° at the turning point, two pages of the book B can be turned by a two-way movement by the book holder 51. This enables the pages of the book B to be promptly turned. Moreover, since the page turning means 60 corresponds to only one direction movement of the book holder 51, the size of the main body of the page turner can be made smaller.

[EMBODIMENT 3]

The following description will discuss another embodiment of the present invention with reference to FIG. 15 through FIGS. 19(*a*)(*b*)(*c*).

Figure 15:
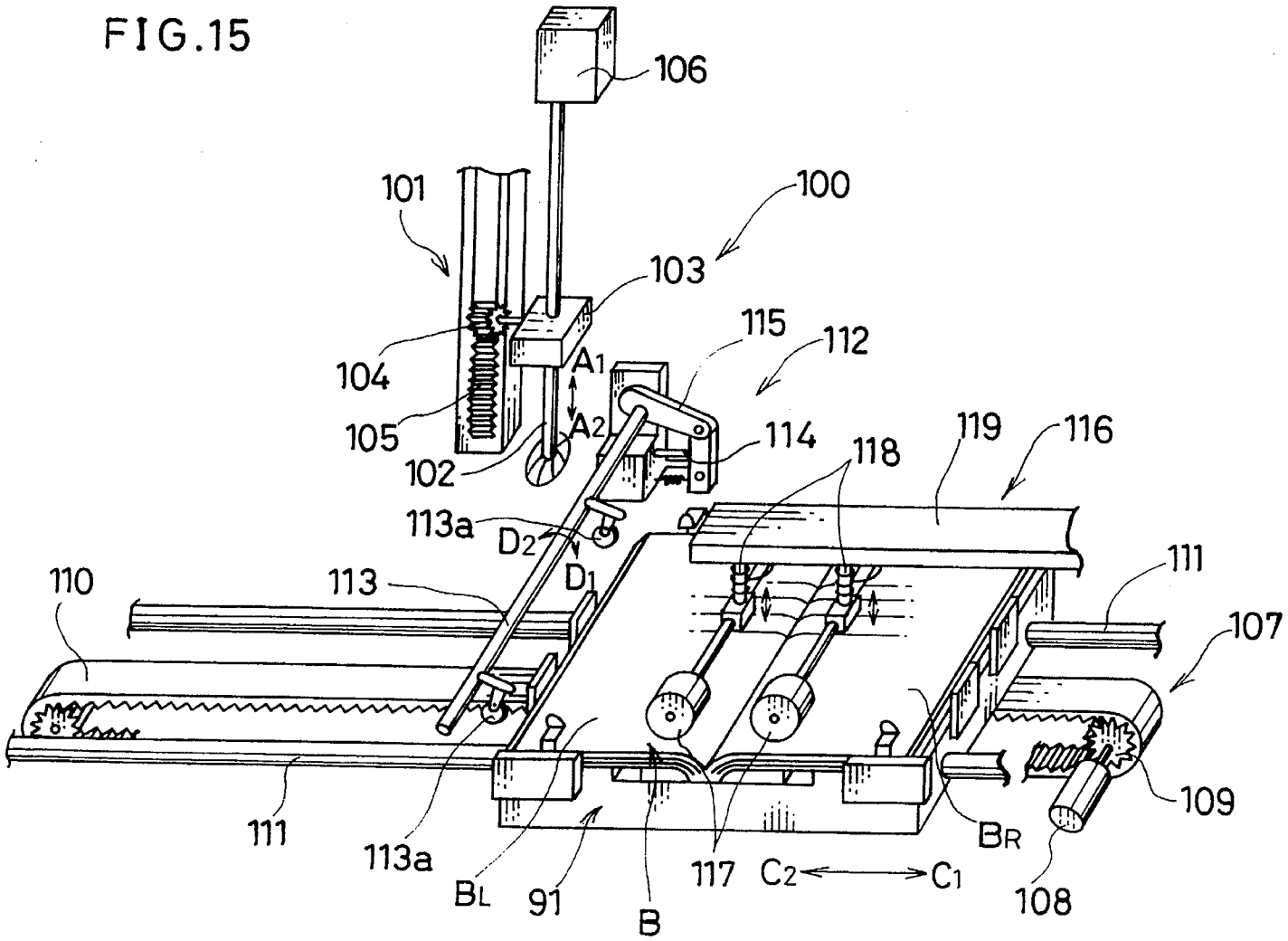
FIG. 15 is a perspective view showing a page turner of another embodiment in accordance with the present invention.
Figure 16:
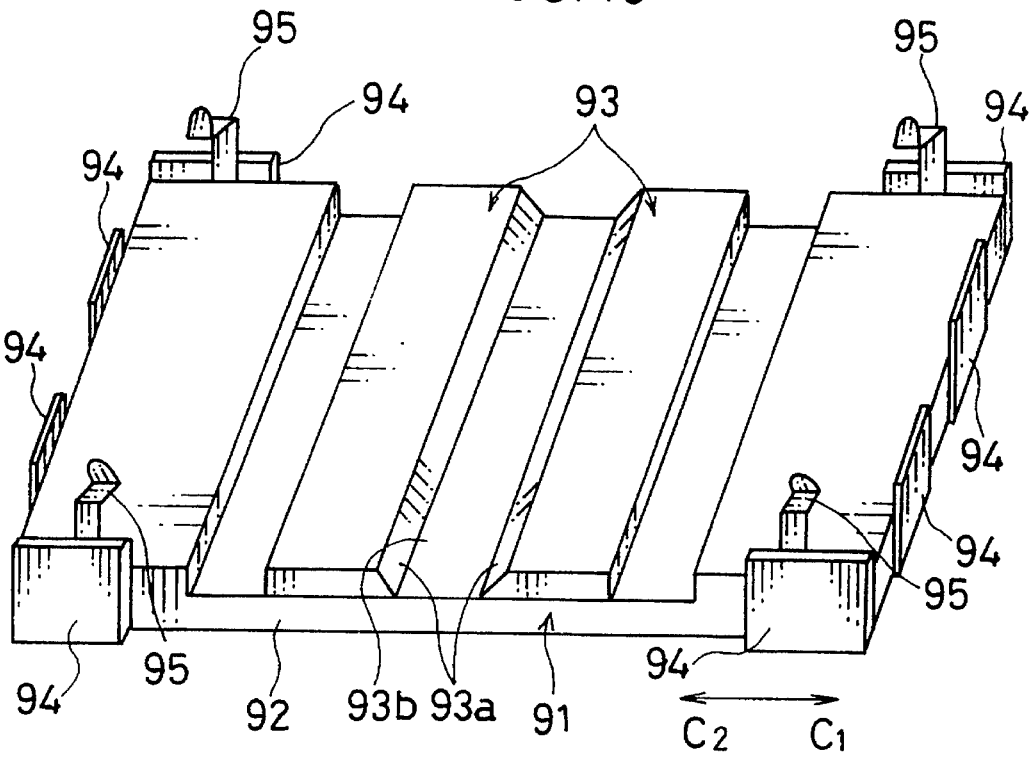
FIG. 16 is a perspective view showing a book holder which is a part of the page turner of FIG. 15.

As shown in FIG. 15, a page turner of the present embodiment is provided with a book holder 91 for placing thereon the book B to be held open, and page turning means 100 for successively turning the pages of the book B held open on the book holder 91. The book holder 91 includes a rectangular base 92, a pair of sliding members 93, a plurality of set position controlling members 94, and four height position controlling members 95. The left and right sliding members 93 are provided with respective sloped side faces 93*a* facing one another so that a groove 93*b* is formed in between. The groove 93*b* is provided at the center of the book holder 91 for accommodating the spine of the book B. The plurality of set position controlling members 94 are provided along the circumference of the base 92 for controlling the set position of the book B held open on the book holder 91. The height position controlling members 95 are provided on the plurality of set position controlling members 94 at four corners of the book holder 91, and controls the height position of the book B.

The sliding members 93 are provided so as to be capable of sliding in the lengthwise direction ($C_1$–$C_2$) of the base 92. This permits to adjust the width of the groove 93*b* according to the thickness of the book B. The respective positions of the set position controlling members 94 to be fitted onto the base 92 can be adjusted according to the size of the book B to be placed on the base 92.

The page turning means 100 is composed of a page suction mechanism 101 for sucking the top page of the opened book B, a book holder transport mechanism 107 for transporting the book holder 91 in the direction of $C_1$–$C_2$, a page dropping mechanism 112 for dropping the page turned from one side onto the other side of the opened book B, and a page pressing mechanism 116 for pressing the surface of the page after being turned.

The page suction mechanism 101 is provided in such a way that an axis thereof is perpendicular to the upper surface of the book holder 91. The page suction mechanism 101 includes a suction nozzle 102 capable of moving in the direction of $A_2$–$A_1$, a motor 103 which serves as a drive source for moving the suction nozzle 102. The page suction mechanism 101 also includes a gear 104, a rack member 105 which transmits the drive force from the motor 103 to the suction nozzle 102, and a vacuum pump 106 which enables the suction nozzle 102 to absorb air through the suction opening.

The book holder transport mechanism 107 includes a motor 108 which serves as a drive force for moving the book holder 91 in the direction of $C_1$–$C_2$, and a gear 109 and a pair of toothed belts 110 which transmit the drive force from the motor 108 as the movement of the book holder 91, and a pair of support guides 111 which support the book holder 91 and control the movement of the book holder 91 in the direction of $C_1$–$C_2$.

The page dropping mechanism 112 is composed of a shaft member 113, a solenoid 114, and an arm member 115. The shaft member 113 is provided in such a way that an axis thereof is set in the direction perpendicular to the moving direction ($A_2$–$A_1$) of the suction nozzle 102 and the moving direction ($C_1$–$C_2$) of the book holder 91. The solenoid 114 serves as a drive source for rotating the shaft member 113 in the direction of $D_1$–$D_2$. The arm member 115 transmits the movement of the solenoid 114 as the rotations of the shaft member 113.

The shaft member 113 is provided with two rollers 113*a* for dropping the page along the shaft portion. When a sensor 128 (to be described later) detects that the page is turned, the solenoid 114 is moved back, and the shaft member 113 rotates the rollers 113*a* downward.

The page pressing mechanism 116 includes a pair of pressure rollers 117, a pair of springs 118 which always exert a force toward the pressure rollers 11.7 downward, and a support member 119 which enables the height of the pressure rollers 117 to be adjusted.

Figure 17:
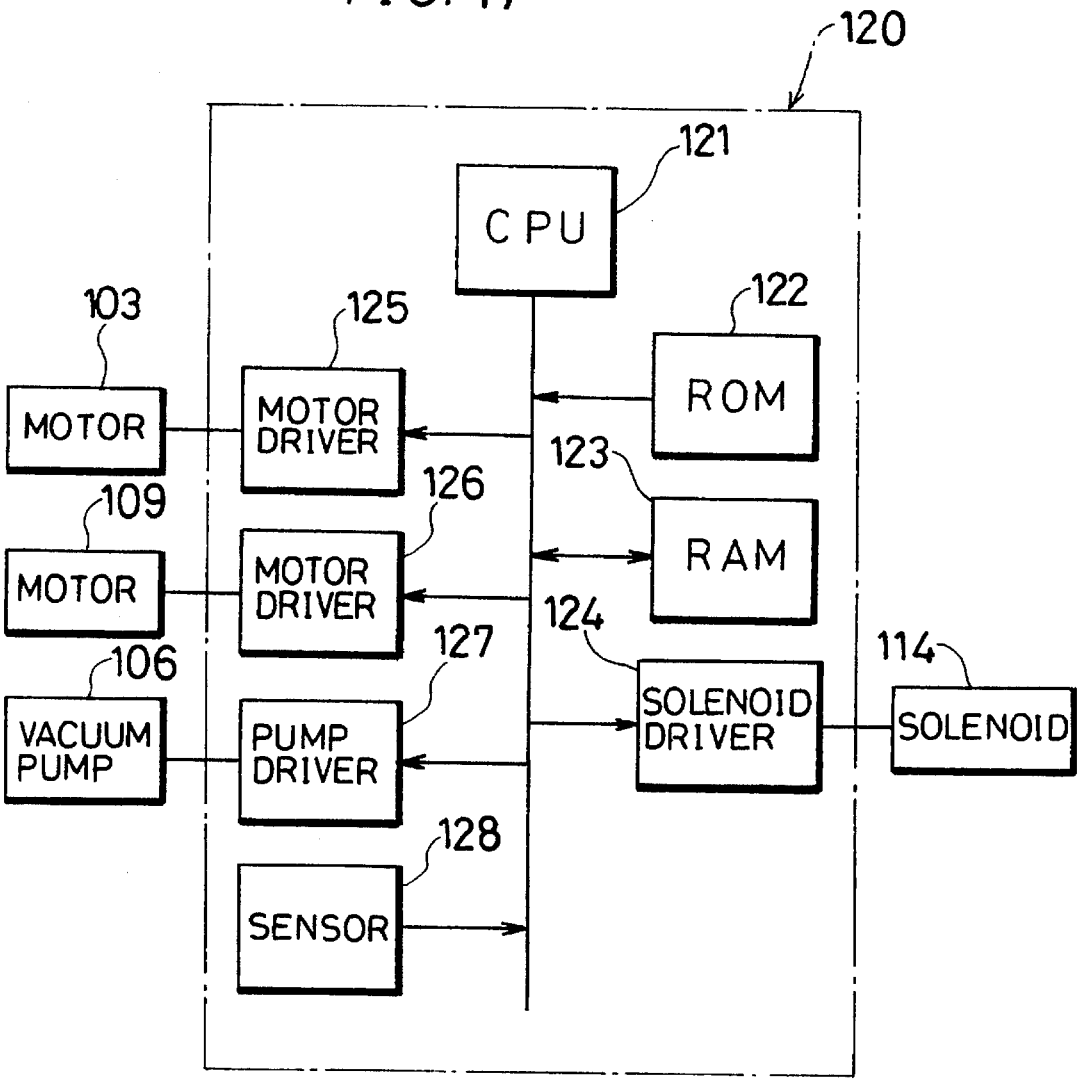
FIG. 17 is a block diagram showing a control section which is a part of the page turner.

As shown in FIG. 17, the page turner of the present embodiment is provided with a control unit 120 (control means) for controlling the operation of the page turning means 100. The control unit 120 includes a CPU 121 (Central Processing Unit) for executing the program by controlling the respective operations of the components. Further, a ROM 122 (Read Only Memory) for storing control programs, and a RAM 123 (Random Access Memory) for storing various kinds of data are connected to the CPU 121.

A solenoid driver 124, motor drivers 125 and 126, a pump driver 127, and a sensor 128 for detecting the turning of the pages are connected to the CPU 121 via an interface (not shown). The solenoid 114 is connected to the solenoid driver 124. Motors 103 and 109 are connected to the respective motor drivers 125 and 126. The vacuum pump 106 is connected to the pump driver 127.

The control unit 120 controls the solenoid driver 124, the motor drivers 125 and 126, and the pump driver 127 based on the control of the CPU 121 using the drive data. As a result, the solenoid driver 124 controls the movement of the solenoid 114, thereby controlling the rotations of the shaft member 113. The motor driver 125 controls the drive of the motor 103 so as to control the movement of the suction nozzle 102. The motor driver 126 controls the drive of the motor 109 so as to control the movement of the book holder 91. Further, the pump driver 127 controls the air-suction of the vacuum pump 106 so as to control the sucking operation of the suction nozzle 102.

Figure 18:
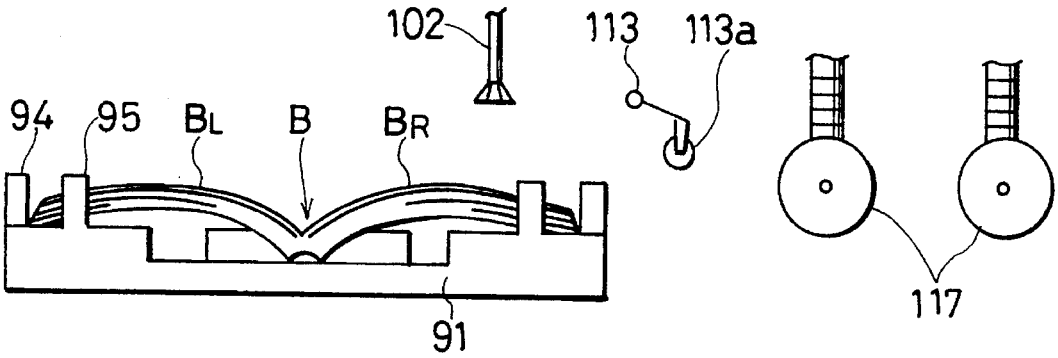
FIG. 18(*a*) is a front view showing a process for sucking a page by the page suction mechanism of the page turner of FIG. 15.
Figure 18:
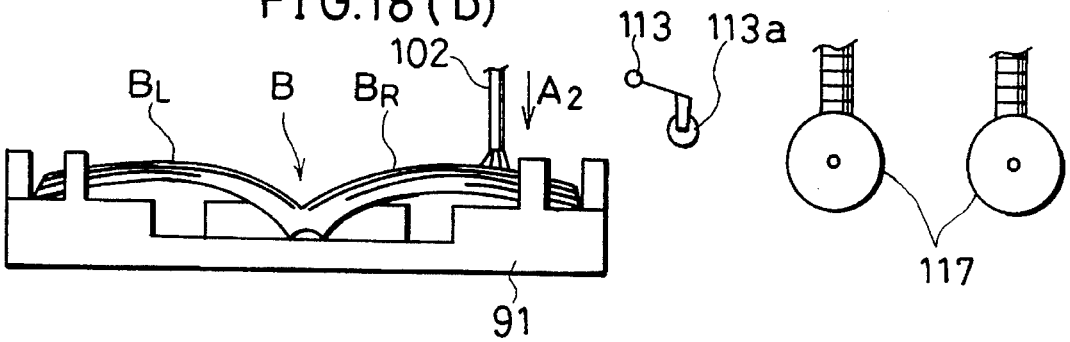
Figure 18:
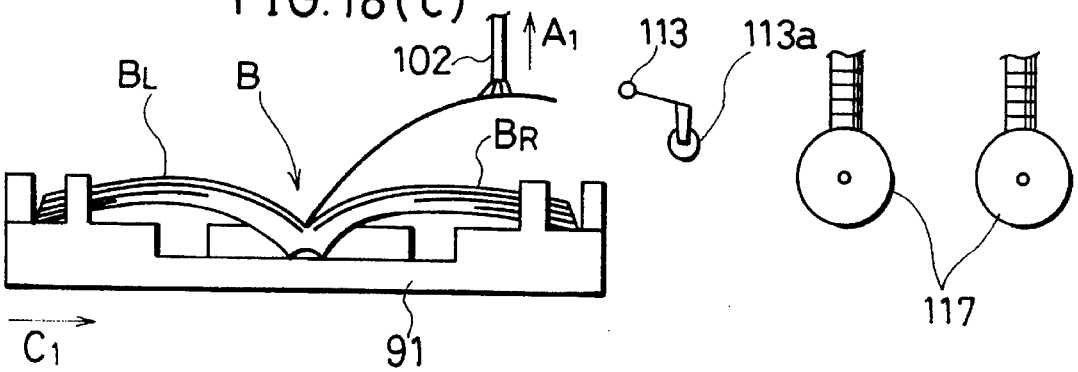
Figure 18:
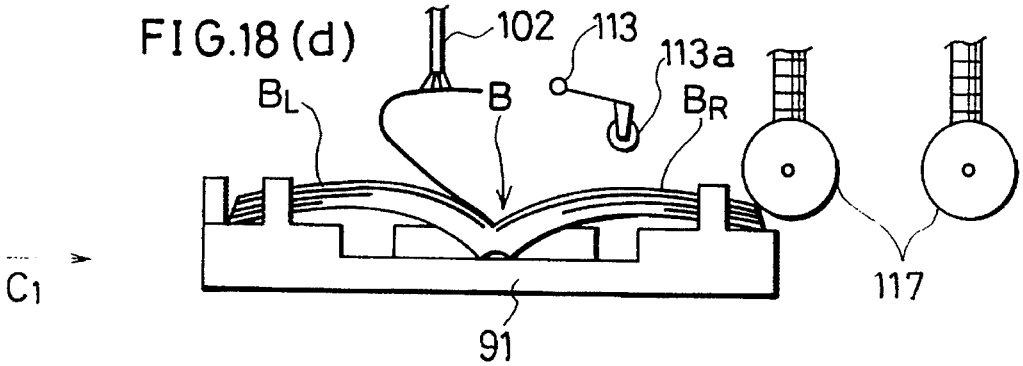
Figure 19:
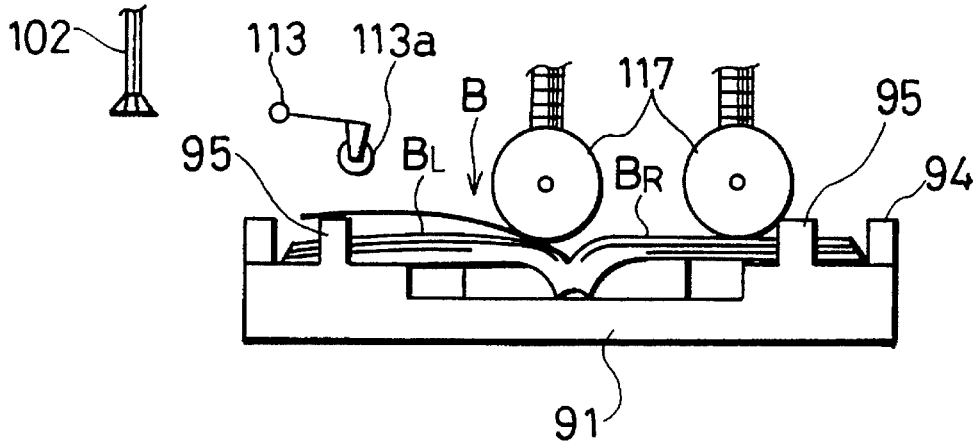
FIG. 19(*a*) is a front view showing a process for pushing a page by the page dropping mechanism of the page turner of FIG. 15.
Figure 19:
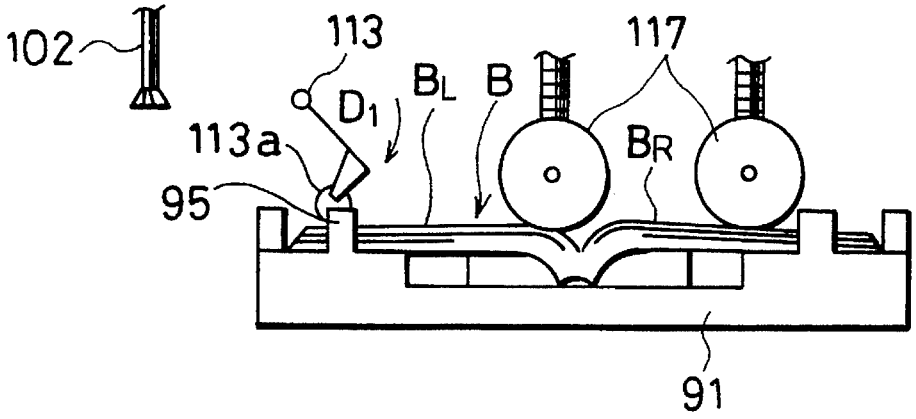
Figure 19:
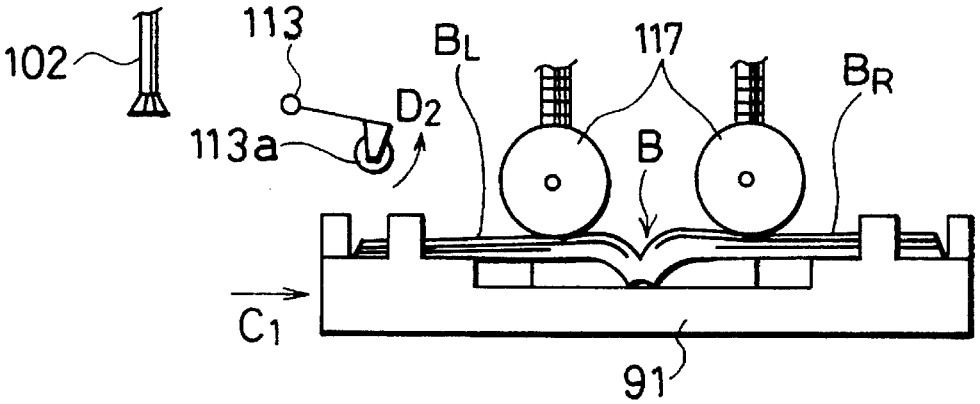
Figure 20:
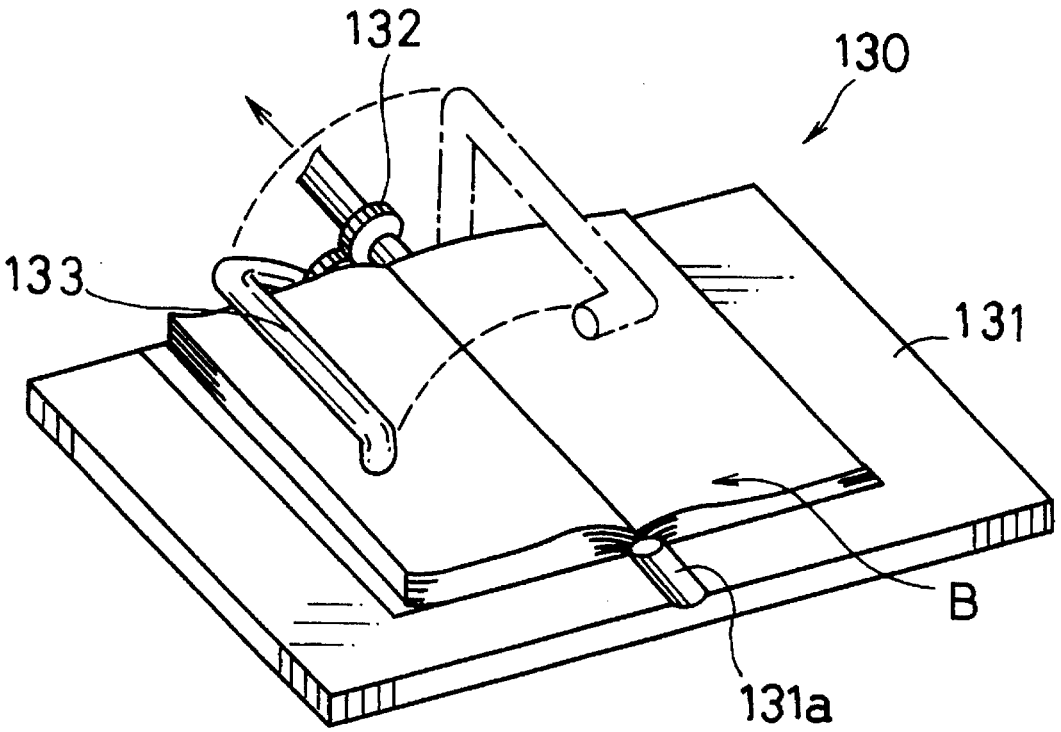
FIG. 20 PRIOR ART
FIG. 20 is a perspective view showing a conventional page turner.

In the above arrangement of the page turner of the present embodiment, the following will discuss a sequential page turning operation with reference to FIGS. 18(*a*)(*b*)(*c*)(*d*), and FIGS. 19(*a*)(*b*)(*c*). In the explanation, the pages of the opened book B are turned from the right hand side $B_R$ to the left hand side $B_L$.

First, the suction nozzle 102 is placed above the right hand side $B_R$ of the opened book B as shown in FIG. 18(*a*). Then, as shown in FIG. 18(*b*), the suction nozzle 102 is moved down in the direction of $A_2$ in the air-suction state. Thus, the right hand side $B_R$ of the top page of the opened book B is sucked by the suction nozzle 102. Thereafter, the suction nozzle 102 moves back in the direction of $A_1$ while sucking the right hand side $B_R$ of the top page of the opened book B as shown in FIG. 18(*c*).

After the suction nozzle 102 in the suction state is moved back, the book holder 91 is moved in the direction of $C_1$ as shown in FIG. 18(*d*). When the book holder 91 is further moved in the direction of $C_1$, the top page of the opened book B ceases from being sucked by the suction nozzle 102, and is released onto the height position controlling members 95 provided above the left hand side $B_L$ of the opened book B as shown in FIG. 19(*a*). In this state, the right hand side $B_R$ of the book B is pressed by the pressure roller 17 with the movement of the book holder 91 in the direction of $C_1$.

When the sensor 128 detects that the page is turned, the shaft member 113 is rotated in the direction of $D_1$ as shown in FIG. 19(*b*). As a result, the top page of the opened book B, placed on the height position controlling members 95 is pressed by the the roller 113*a* for dropping pages of the shaft member 113. Then, as shown in FIG. 19(*c*), when the shaft member 113 is rotated in the direction of $D_2$, the book holder 91 is slightly moved in the direction of $C_1$. As a result, the left hand side $B_L$ of the opened book B is pressed by the pressure roller 117 just like the right hand side $B_R$. Then, the above sequential page turning operation is terminated. Thereafter, by repeating the above process, the pages of the book B are successively turned one by one.

As described, the page turner of the present embodiment is arranged such that the book holder 91 for placing thereon the book B to be held open includes the set position controlling member 94 for controlling the set position of the book B held open on the book holder 91, and the height position controlling member 95 for controlling the respective height positions of the top pages on the left hand side $B_L$ and the right hand side $B_R$ of the opened book B to be predetermined height positions.

In the above arrangement, since the respective positions of the book B held open on the book holder 91 are controlled by the members 94 and 95, the book B can be held open at a predetermined position, thereby enabling a stable page turning operation.

However, the present invention is not limited to the described arrangements of the first, the second, and the third embodiments. Other arrangements may be adopted. For example, in the first embodiment, the page turning means 10 is composed of the page suction mechanism 11, the book holder transport mechanism 17, and the page dropping mechanism 21. However, the arrangement of the page turning means 10 is not limited to the above mechanisms.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A page turner comprising:

a book holder including support plates which respectively support a left hand side and a right hand side of a book held open on said book holder;

a pair of support plate moving means for respectively activating the support plate on the left hand side and the support plate on the right hand side to move up and down;

height position controlling members, provided in predetermined height positions respectively above the left hand side and the right hand side of the book; and page turning means for successively turning pages of the book held open on said book holder.

2. The page turner as set forth in claim 1, wherein said support plate moving means includes:

drive means for generating a drive force for moving said support plate; and transmission means for transmitting the drive force from said drive means to said support plate.

3. The page turner as set forth in claim 2, wherein said drive means is a motor, and said transmission means includes:

a gear coupled to a drive shaft of the motor; and a rack member provided perpendicularly from a center of a back surface of said support plate, so as to mesh with said gear.

4. The page turner as set forth in claim 1, further comprising:

a guide shaft, provided perpendicularly from a back surface of said support plate, for controlling a moving direction of said support plate.

5. The page turner as set forth in claim 1, wherein said height position controlling members for controlling the height position of the book are provided at four corners of said book holder.

6. The page turner as set forth in claim 1, wherein said page turning means includes:

page raising means for raising a top page of the book held open on said book holder, and also for enabling the top page to be released;

book holder moving means for moving said book holder along a lengthwise direction thereof; and page dropping means for dropping the page turned from one side to the other side of the book.

7. The page turner as set forth in claim 6, wherein said page raising means includes:

a suction nozzle for air-sucking the pages of the book; and nozzle moving means for moving said suction nozzle along the moving direction of said support plate.

8. The page turner as set forth in claim 7, wherein said nozzle moving means includes:

drive means for generating a drive force for moving said suction nozzle; and transmission means for transmitting the drive force from said drive means to said suction nozzle.

9. The page turner as set forth in claim 8, wherein said drive means is a motor, and said transmission means includes:

a gear coupled to a drive shaft of the motor;

a toothed belt provided so as to mesh with said gear; and a connecting member for connecting said toothed belt and said suction nozzle.

10. The page turner as set forth in claim 6, wherein said book holder moving means includes:

drive means for generating a drive force for moving said book holder; and transmission means for transmitting the drive force from said drive means to said book holder.

11. The page turner as set forth in claim 10, wherein said drive means is a motor, and said transmission means includes:

a gear coupled to a drive shaft of the motor, and a toothed belt mounted to said book holder so as to mesh with said gear.

12. The page turner as set forth in claim 6, wherein said page dropping means includes:

a shaft member provided with parts for dropping pages by rotating; and a motor which serves as a drive source for rotating said shaft member.

13. The page turner as set forth in claim 1, further comprising:

control means for controlling respective operations of said page turning means and said support plate moving means; and detection means for detecting the operation of said page turning means, and also for controlling said control means based on a result of detection.

14. A page turner comprising:

a book holder provided with a support plate for supporting a book held open;

support plate rotation means for rotating said support plate;

book holder moving means for moving said book holder along a lengthwise direction thereof; and page raising means for raising a top page of the book held open on said book holder, and also for enabling the top page to be released.

15. The page turner as set forth in claim 14, wherein said support plate rotation means is a motor whose drive shaft is coupled to said support plate.

16. The page turner as set forth in claim 14, wherein said book holder moving means includes:

drive means for generating a drive force for moving said book holder; and transmission means for transmitting the drive force from said drive means to said book holder.

17. The page turner as set forth in claim 16, wherein said drive means is a motor, and said transmission means includes:

a gear coupled to a drive shaft of the motor, and a toothed belt mounted to said book holder so as to mesh with said gear.

18. The page turner as set forth in claim 14, wherein said page raising means includes:

a suction nozzle for air-sucking pages of the book; and nozzle moving means for moving said suction nozzle in a direction perpendicular to a support face of said support plate.

19. The page turner as set forth in claim 18, wherein said nozzle moving means includes:

drive means for generating a drive force for moving said suction nozzle; and transmission means for transmitting the drive force from said drive means to said suction nozzle.

20. The page turner as set forth in claim 19, wherein said drive means is a motor, and said transmission means includes:

a gear coupled to a drive shaft of the motor;

a toothed belt provided so as to mesh with said gear; and a connecting member for connecting said toothed belt and said suction nozzle.

21. The page turner as set forth in claim 14, further comprising:

control means for controlling respective operations of said support plate rotation means, said book holder moving means, and said page raising means.

22. A page turner comprising:

book holder for placing thereon a book held open;

a position controlling member, provided along a circumference of said book holder, for controlling the position of the book to be set on said book holder;

height position controlling members, provided on predetermined height positions respectively above the left hand side and the right hand side of the book; and page turning means for successively turning pages of the book held open on said book holder;

said position controlling member being provided in such a way that a mounted position thereof can be adjusted relative to said book holder so that the position of the book to be set can be adjusted according to the size of the book.

23. The page turner as set forth in claim 22, wherein said height position controlling member is provided in such a way that the height position of said book holder can be adjusted according to the thickness of the book.

24. A page turner comprising:

book holder for placing thereon a book held open;

a position controlling member, provided along a circumference of said book holder, for controlling the position of the book to be set on said book holder;

height position controlling members, provided in predetermined height positions respectively above the left hand side and the right hand side of the book;

page turning means for successively turning pages of the book held open on said book holder; and a pair of sliding members which form a groove for accommodating a spine of the book held open, said pair of sliding members being capable of sliding along a lengthwise direction of said book holder so as to adjust a width of the groove.

25. A page turner comprising:

book holder for placing thereon a book held open;

a position controlling member, provided along a circumference of said book holder, for controlling the position of the book to be set on said book holder;

height position controlling members, provided in predetermined height positions respectively above the left hand side and the right hand side of the book;

page turning means for successively turning pages of the book held open on said book holder;.

page raising means for raising a top page of the book held open on said book holder, and also for enabling the top page to be released;

book holder moving means for moving said book holder along a lengthwise direction thereof;

page dropping means for dropping the page turned from one side to the other side of the book; and page pressing means for pressing the turned page.

26. The page turner as set forth in claim 25, wherein said page raising means includes:

a suction nozzle for air-sucking the pages of the book; and nozzle moving means for moving said suction nozzle in a direction perpendicular to a support face of said support plate.

27. The page turner as set forth in claim 26, wherein said nozzle moving means includes:

drive means for generating a drive force for moving said suction nozzle; and convert means for converting the drive force from said drive means into a movement of said suction nozzle.

28. The page turner as set forth in claim 27, wherein said drive means is a motor, and said convert means includes:

a gear coupled to a drive shaft of the motor; and a rack member provided so as to mesh with said gear.

29. The page turner as set forth in claim 25, wherein said book holder moving means includes:

drive means for generating a drive force for moving said book holder; and transmission means for transmitting the drive force from said drive means to said book holder.

30. The page turner as set forth in claim 29, wherein said drive means is a motor, and said transmission means includes:

a gear coupled to a drive shaft of the motor;

a toothed belt mounted to said book holder so as to mesh with said gear.

31. The page turner as set forth in claim 25, wherein said book holder moving means for supporting said book holder includes a support guide for controlling a moving direction of said book holder.

32. The page turner as set forth in claim 25, wherein said page dropping means includes:

a shaft member provided with parts for dropping pages by rotating; and shaft rotation means for rotating said shaft member.

33. The page turner as set forth in claim 32, wherein the part for dropping pages is provided with a roller for dropping pages.

34. The page turner as set forth in claim 32, wherein said shaft rotation means includes:

drive means for generating a drive force for rotating said shaft member; and transmission means for transmitting a drive force from said drive means to said shaft member.

35. The page turner as set forth in claim 34, wherein said drive means is a solenoid; and said transmission means is an arm member for transmitting the movement of said solenoid as rotations of said shaft member.

36. The page turner as set forth in claim 25, wherein said page pressing means includes:

a page pressing roller;

a spring which always exerts a force onto said page pressing roller downward; and a support member for supporting said page pressing roller so that the height position thereof can be adjusted.

37. The page turner as set forth in claim 25, further comprising:

control means for controlling respective operations of said page raising means, said book holder moving means, and said page dropping means; and a sensor for detecting a page turning state, and for controlling said page dropping means by said control means based on a result of detection.

* * * * *